US010358309B2

(12) United States Patent
Yamane et al.

(10) Patent No.: US 10,358,309 B2
(45) Date of Patent: Jul. 23, 2019

(54) SHEET CONVEYING DEVICE, IMAGE FORMING APPARATUS INCORPORATING THE SHEET CONVEYING DEVICE, AND POST PROCESSING DEVICE INCORPORATING THE SHEET CONVEYING DEVICE

(71) Applicants: Jun Yamane, Kanagawa (JP); Hiromichi Matsuda, Kanagawa (JP); Tetsuo Watanabe, Kanagawa (JP); Katsuaki Miyawaki, Kanagawa (JP); Hideyuki Takayama, Kanagawa (JP)

(72) Inventors: Jun Yamane, Kanagawa (JP); Hiromichi Matsuda, Kanagawa (JP); Tetsuo Watanabe, Kanagawa (JP); Katsuaki Miyawaki, Kanagawa (JP); Hideyuki Takayama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/925,916

(22) Filed: Mar. 20, 2018

(65) Prior Publication Data

US 2018/0273323 A1 Sep. 27, 2018

(30) Foreign Application Priority Data

Mar. 21, 2017 (JP) ..... 2017-054493
Feb. 27, 2018 (JP) ..... 2018-033204

(51) Int. Cl.
*B65H 7/14* (2006.01)
*B65H 9/00* (2006.01)
(Continued)

(52) U.S. Cl.
CPC ..... *B65H 7/14* (2013.01); *B65H 9/002* (2013.01); *B65H 9/103* (2013.01); *B65H 9/106* (2013.01);
(Continued)

(58) Field of Classification Search
CPC ... B65H 7/02; B65H 7/14; B65H 9/00; B65H 9/106; B65H 9/20; B65H 2511/20; B65H 2511/22; B65H 2511/224
(Continued)

(56) References Cited

U.S. PATENT DOCUMENTS 9,776,819 B2 * 10/2017 Yamane ..... B65H 9/002
2004/0215411 A1 * 10/2004 Howe ..... B65H 9/106 702/85
(Continued)

FOREIGN PATENT DOCUMENTS

JP 6-234441 8/1994
JP 9-175694 7/1997
(Continued)

*Primary Examiner* — David H Bollinger
(74) *Attorney, Agent, or Firm* — Harness, Dickey & Pierce, P.L.C.

(57) ABSTRACT

A sheet conveying device, which is included in an image forming apparatus and a post processing device, includes multiple position detectors and a position corrector. The multiple position detectors are aligned along a sheet conveying direction and configured to detect a side end of a sheet. The position corrector is configured to convey the sheet and correct a position of the sheet based on a positional deviation amount of the sheet, obtained by a detection result of the multiple position detectors. The positional deviation amount of the sheet is obtained by an extreme downstream position detector in the sheet conveying direction, of the multiple position detectors. A position of a subsequent sheet is corrected based on a sum of the positional deviation amount of the sheet and a positional deviation amount of the subsequent sheet.

14 Claims, 22 Drawing Sheets

(51) Int. Cl.
*B65H 9/10* (2006.01)
*B65H 9/20* (2006.01)
*G03G 15/00* (2006.01)

(52) U.S. Cl.
CPC ..... *B65H 9/20* (2013.01); *G03G 15/5029* (2013.01); *G03G 15/6561* (2013.01); *G03G 15/6567* (2013.01); *B65H 2553/416* (2013.01); *B65H 2553/82* (2013.01); *B65H 2601/272* (2013.01); *G03G 15/6529* (2013.01)

(58) Field of Classification Search
USPC ..... 271/227
See application file for complete search history.

(56) References Cited

U.S. PATENT DOCUMENTS

| | | | | |
|---|---|---|---|---|
| 2009/0166960 | A1* | 7/2009 | Ishikawa | B65H 9/106 271/227 |
| 2016/0159598 | A1 | 6/2016 | Yamane et al. | |
| 2018/0162667 | A1* | 6/2018 | Matsuda | B65H 9/20 |
| 2018/0194581 | A1* | 7/2018 | Matsumoto | B65H 7/08 |

FOREIGN PATENT DOCUMENTS

| | | |
|---|---|---|
| JP | 10-067448 | 3/1998 |
| JP | 10-120253 | 5/1998 |
| JP | 2005-041603 | 2/2005 |
| JP | 2005-041604 | 2/2005 |
| JP | 2005-053646 | 3/2005 |
| JP | 2005-178929 | 7/2005 |
| JP | 2006-027859 | 2/2006 |
| JP | 2007-022806 | 2/2007 |
| JP | 2008-308334 | 12/2008 |
| JP | 2011-098790 | 5/2011 |
| JP | 2014-088263 | 5/2014 |
| JP | 2014-193769 | 10/2014 |
| JP | 2016-024546 | 2/2016 |
| JP | 2016-044067 | 4/2016 |
| JP | 2016-108152 | 6/2016 |
| JP | 2016-175776 | 10/2016 |
| JP | 2016-188142 | 11/2016 |

* cited by examiner

SHEET CONVEYING DEVICE, IMAGE FORMING APPARATUS INCORPORATING THE SHEET CONVEYING DEVICE, AND POST PROCESSING DEVICE INCORPORATING THE SHEET CONVEYING DEVICE

CROSS-REFERENCE TO RELATED APPLICATIONS

This patent application is based on and claims priority pursuant to 35 U.S.C. § 119(a) to Japanese Patent Application Nos. 2017-054493, filed on Mar. 21, 2017, and 2018-033204, filed on Feb. 27, 2018, in the Japan Patent Office, the entire disclosure of each of which is hereby incorporated by reference herein.

BACKGROUND

Technical Field

This disclosure relates to a sheet conveying device that conveys a sheet, an image forming apparatus including the sheet conveying device, and a post processing device including the sheet conveying device.

Related Art

Various kinds of image forming apparatuses such as copiers and printers employ a technique, for example, to detect an angular displacement amount and a lateral displacement amount of the sheet in conveyance of a sheet such as a paper material and an OHP (overhead projector) film sheet and to correct the position of the sheet to a correct position.

A known sheet conveying device corrects the position of a sheet by causing a pair of sheet holding rollers that holds the sheet to rotate about a shaft that extends to intersect with a sheet plane of conveyance and/or move in the axial direction.

In order to detect a positional deviation amount generated during conveyance of a sheet by a pair of sheet holding rollers, the known sheet conveying device includes a pair of sheet holding rollers, a contact image sensor (CIS) disposed upstream from the pair of sheet holding rollers in a sheet conveying direction, and a contact image sensor (CIS) disposed downstream from the pair of sheet holding rollers in the sheet conveying direction. These CISs detect the position of the sheet.

According to this configuration, the CISs detect the position of a side end (i.e., one end in the width direction) of the sheet, and therefore the pair of sheet holding rollers can detect the positional deviation of the sheet during conveyance.

SUMMARY

At least one aspect of this disclosure provides a sheet conveying device including multiple position detectors and a position corrector. The multiple position detectors are aligned along a sheet conveying direction and configured to detect a side end of a sheet. The position corrector is configured to convey the sheet and correct a position of the sheet based on a positional deviation amount of the sheet, obtained by a detection result of the multiple position detectors. The positional deviation amount of the sheet is obtained by an extreme downstream position detector in the sheet conveying direction, of the multiple position detectors. A position of a subsequent sheet is corrected based on a sum of the positional deviation amount of the sheet and a positional deviation amount of the subsequent sheet.

Further, at least one aspect of this disclosure provides an image forming apparatus including the above-described sheet conveying device.

Further, at least one aspect of this disclosure provides a post processing device including a sheet receiving device configured to receive a sheet conveyed from an image forming apparatus and the above-described sheet conveying device.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
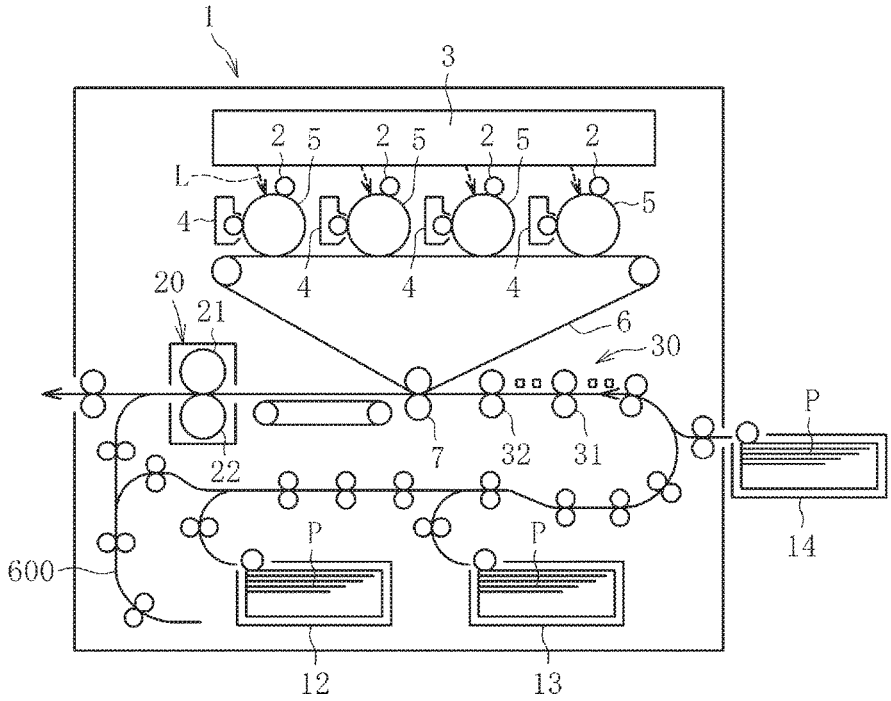
FIG. 1 is a schematic diagram illustrating an entire configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Descriptions are given of an example applicable to a sheet conveying device, an image forming apparatus incorporating the sheet conveying device, and a post processing device incorporating the sheet conveying device.

It is to be noted that elements (for example, mechanical parts and components) having the same functions and shapes are denoted by the same reference numerals throughout the specification and redundant descriptions are omitted.

First, referring to FIG. 1, a description is given of a configuration and functions of the image forming apparatus 1 according to an embodiment of this disclosure, with reference to FIG. 1.

The image forming apparatus 1 may be a copier, a facsimile machine, a printer, a multifunction peripheral or a multifunction printer (MFP) having at least one of copying, printing, scanning, facsimile, and plotter functions, or the like. According to the present example, the image forming apparatus 1 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., a OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

In FIG. 1, the image forming apparatus 1 includes charging units 2, an exposure device 3, image forming devices 4, multiple (four, in this case) photoconductors 5, a primary transfer portion (an intermediate transfer belt) 6, a secondary transfer portion (a secondary transfer roller) 7, a first sheet feeding unit 12, a second sheet feeding unit 13, a third sheet feeding unit 14, a fixing device 20, a fixing roller 21, a pressure roller 22, a sheet conveying device 30, a pair of sheet holding rollers 31, and a pair of timing rollers 32.

The charging units 2 uniformly charge respective surfaces of the multiple photoconductors 5.

The exposure device 3 emits respective exposure lights L to the respective surfaces of the photoconductors 5.

The developing devices 4 form a toner image (an image) on the respective surfaces of the multiple photoconductors 5.

The primary transfer portion (the intermediate transfer belt) 6 is a portion onto which the toner image formed on each of the multiple photoconductors 5 is primarily transferred.

The secondary transfer portion (the secondary transfer roller) 7 is a portion to transfer the toner image from the primarily transfer portion 6 to a sheet P.

The first sheet feeding unit 12, the second sheet feeding unit 13, and the third sheet feeding unit 14 are sheet feeding portions (sheet trays), each of which contains the sheet P therein.

The fixing device 20 includes the fixing roller 21 and the pressure roller 22 to fix an unfixed image formed on the sheet P to the sheet P by application of heat by the fixing roller 21 and pressure by the pressure roller 22.

The sheet conveying device 30 conveys the sheet P through a sheet conveyance passage.

The pair of sheet holding rollers 31 functions as a pair of correction rollers to correct the attitude and position of the sheet P while conveying the sheet P.

The pair of timing rollers 32 adjusts a timing of conveyance of the sheet P (i.e., changes a conveying speed of the sheet P) to the secondary transfer portion 7.

Figure 2:
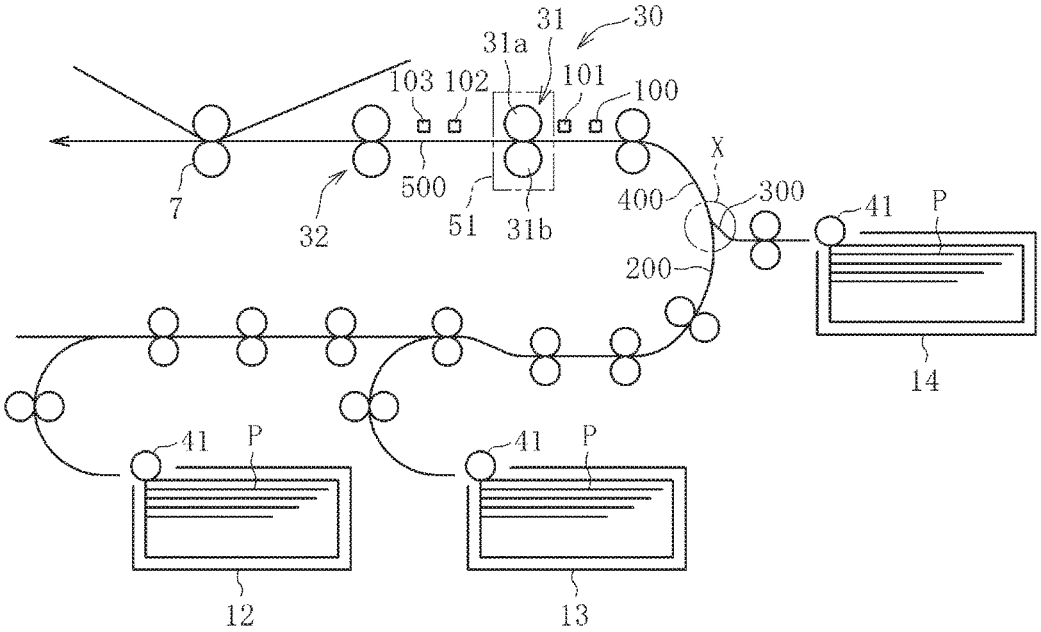
FIG. 2 is a schematic diagram illustrating a pair of sheet holding rollers and parts and units disposed near the pair of sheet holding rollers.

A description is given of regular image forming operations performed in the image forming apparatus 1 according to an embodiment of this disclosure, with reference to FIGS. 1 and 2. FIG. 2 is a schematic diagram illustrating the pair of sheet holding rollers 31 and parts and units disposed near the pair of sheet holding rollers 31.

The charging units 2 uniformly charge the respective surfaces of the multiple photoconductors 5 to a predetermined polarity (a charging process).

Then, based on image data of an original document read by an image reading device or a computer, the exposure device 3 emits laser light L onto the respective charged surfaces of the multiple photoconductors 5 to irradiate the respective surfaces of the photoconductors 5 so as to form respective electrostatic latent images on the respective surfaces of the photoconductors 5 (an exposing process).

The developing devices 4 supply toner onto the respective surfaces of the photoconductors 5 with different colors (for example, yellow, magenta, cyan and black) so that the respective electrostatic latent images formed on the respective surfaces of the photoconductors 5 are developed into respective visible toner images (a developing process).

Then, the respective toner images formed on the respective surfaces of the photoconductors 5 are primarily transferred one on another in layers onto the primarily transfer portion 6 to form a composite color image. Thereafter, the composite color image is secondarily transferred onto the sheet by the secondary transfer portion 7.

The sheet P is conveyed manually or automatically from a selected one of the first sheet feeding unit 12, the second sheet feeding unit 13 and the third sheet feeding unit 14. For example, when one of the first sheet feeding unit 12 and the second sheet feeding unit 13 disposed inside an apparatus body of the image forming apparatus 1 is selected, the sheet P stored in the selected one of the first sheet feeding unit 12 and the second sheet feeding unit 13 is fed by a sheet feed roller 41 toward a first curved sheet conveyance passage 200, as illustrated in FIG. 2. By contrast, when the third sheet feeding unit 14 disposed outside the apparatus body of the image forming apparatus 1 is selected, the sheet P stored in the third sheet feeding unit 14 is fed by the sheet feed roller 41 toward a second curved sheet conveyance passage 300, as illustrated in FIG. 2. The first curved sheet conveyance passage 200 and the second curved sheet conveyance passage 300 meet at a meeting point X to continuously extend to a third curved sheet conveyance passage 400. Therefore, the sheet P fed from any one of the first sheet feeding unit 12, the second sheet feeding unit 13 and the third sheet feeding unit 14 passes the meeting point X to enter the third curved sheet conveyance passage 400. Thereafter, the sheet P passes through a straight sheet conveyance passage 500 and reaches the position of the pair of sheet holding rollers 31 that forms an alignment unit 51. Then, the pair of sheet holding rollers 31 corrects the position of the sheet P in the width direction and the rotational direction, which is a correction of lateral and angular displacements of the sheet P. Then, the pair of timing rollers 32 conveys the sheet P toward the secondary transfer portion 7 in synchronization with movement of the toner image formed on the photoconductor 5.

After the toner image is transferred onto the sheet P at the secondary transfer portion 7, the sheet P is conveyed to the fixing device 20. The sheet P that has been conveyed to the fixing device 20 is sent and held between the fixing roller 21 and the pressure roller 22. Thus, the unfixed toner image on the sheet P is fixed to the sheet P by application of apply and pressure. Consequently, the sheet P is discharged from the image forming apparatus 1.

When a duplex printing mode in which respective images are printed both sides (i.e., a front side and a back side) of the sheet P is selected, a toner image after completion of the charging process, the exposing process and the developing process is transferred onto one side (e.g., the front side) of the sheet P. However, the sheet P is not discharged from the image forming apparatus 1 after the fixing process but is guided to a sheet reverse conveyance passage 600, as illustrated in FIG. 1. The sheet P conveyed to the sheet reverse conveyance passage 600 is switched back (i.e., the direction of conveyance of the sheet P is reversed) in the sheet reverse conveyance passage 600, and is then conveyed to the secondary transfer portion 7 again via the first curved sheet conveyance passage 200, the third curved sheet conveyance passage 400 and the straight sheet conveyance passage 500. Then, a toner image after completion of the charging process, the exposing process and the developing process is transferred onto the other side (e.g., the back side) of the sheet P. This time, the sheet P is discharged from the image forming apparatus 1 after the fixing process by the fixing device 20.

A series of image forming processes is described above. However, in addition to the above-described image forming processes, the image forming apparatus 1 can form a single color image by any one of the photoconductors 5, or form a composite color image of two or three colors by any two or three of the photoconductors 5.

Next, a description is given of the sheet conveying device 30 according to the present embodiment of this disclosure.

It is to be noted that, hereinafter, "an upstream side in the sheet conveying direction" of the sheet conveyance passage is referred to simply as "an upstream side", and "a downstream side in the sheet conveying direction" of the sheet conveyance passage is referred to simply as "a downstream side."

Figure 3A:
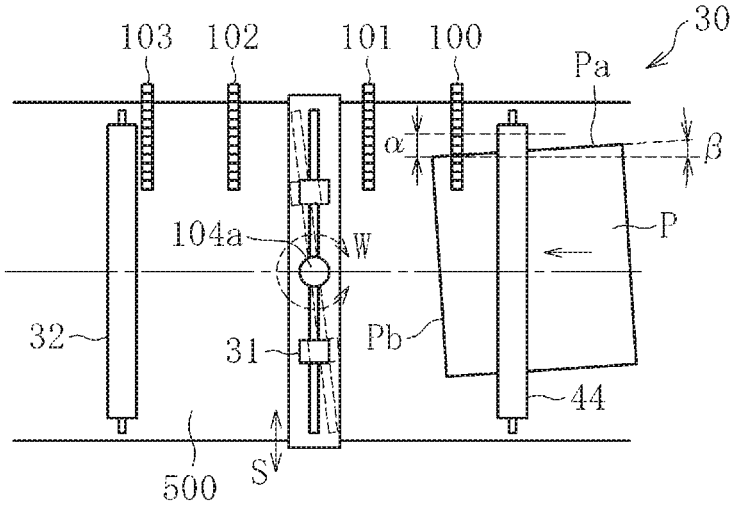
FIG. 3A is a plan view illustrating a schematic diagram of the pair of sheet holding rollers and parts and units disposed near the pair of sheet holding rollers.
Figure 3B:
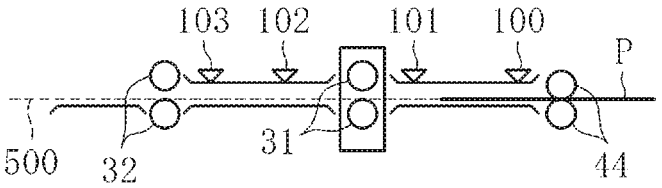
FIG. 3B is a side view illustrating a schematic diagram.

FIG. 3A is a plan view illustrating a schematic configuration of the pair of sheet holding rollers 31 and parts and units disposed near the pair of sheet holding rollers 31. FIG. 3B is a side view of FIG. 3A.

As illustrated in FIGS. 3A and 3B, the sheet conveying device 30 includes multiple CISs 100, 101, 102 and 103 and the pair of sheet holding rollers 31. Each of the multiple CISs 100, 101, 102 and 103 functions as a position detector to detect the position of the sheet P. The pair of sheet holding rollers 31 functions as a position corrector to correct the position of the sheet P. The CIS 100 is referred to as a "first CIS 100" that functions as a first position detector, the CIS 101 is referred to as a "second CIS 101" that functions as a second position detector, the CIS 102 is referred to as a "third CIS 102" that functions as a third position detector, and the CIS 103 is referred to as a "fourth CIS 103" that functions as a fourth position detector.

The first CIS 100, the second CIS 101, the third CIS 102 and the fourth CIS 103 are disposed in this order from the upstream side (i.e., the right side of FIGS. 3A and 3B) of the straight sheet conveyance passage 500. Specifically, the first CIS 100 and the second CIS 101 are disposed at the upstream side from the pair of sheet holding rollers 31 and at the downstream side from the pair of sheet conveying rollers 44 that is disposed at one upstream position from the pair of sheet holding rollers 31. By contrast, the third CIS 102 and the fourth CIS 103 are disposed at the downstream side from the pair of sheet holding rollers 31 and at the upstream side from the pair of timing rollers 32. The first CIS 100, the second CIS 101, the third CIS 102 and the fourth CIS 103 are disposed parallel to each other relative to the width direction of the sheet P (i.e., a direction perpendicular to the sheet conveying direction). At the same time, the relative positions to the sheet conveying direction and the positional relation to parts and units disposed in the vicinity of the pair of sheet holding rollers 31 are previously determined.

The "CIS" stands for a contact image sensor that contributes to a reduction in size of a device in recent years. The CIS uses small-size LEDs (light emitting diodes) as a light source to directly read an image by linear sensors via lenses. Each of the first CIS 100, the second. CIS 101, the third CIS 102 and the fourth CIS 103 includes multiple line sensors aligned in the width direction of the sheet P so as to detect a side edge Pa of one end side in the width direction of the sheet P, as illustrated in FIG. 3A.

It is to be noted that the position detector is not limited to a CIS but may be any detector such as photosensors disposed along the width direction of the sheet P as long as the detector detects the side edge Pa of a sheet P.

The pair of sheet holding rollers 31 functions as the alignment unit 51 to perform alignment of lateral correction (i.e., correction to a lateral displacement $\alpha$ of the sheet P illustrated in FIG. 3A) and angular correction (i.e., correction to an angular displacement 13 of the sheet P illustrated in FIG. 3A). Therefore, the pair of sheet holding rollers 31 is rotatable about a shaft 104*a* that is provided at the axial center of the pair of sheet holding rollers 31 in a direction indicated by arrow W in FIG. 3A (i.e., in a rotational direction within a plane of sheet conveyance or a plane of conveyance of a conveyance target medium corresponding to a direction of angular displacement of the sheet P) and is movable in a direction indicated by arrow S in FIG. 3A (i.e., in a width direction of the sheet or the conveyance target medium). It is to be noted that the pair of sheet holding rollers 31 may be rotatable in the direction W about a shaft provided at one axial end thereof.

Figure 4:
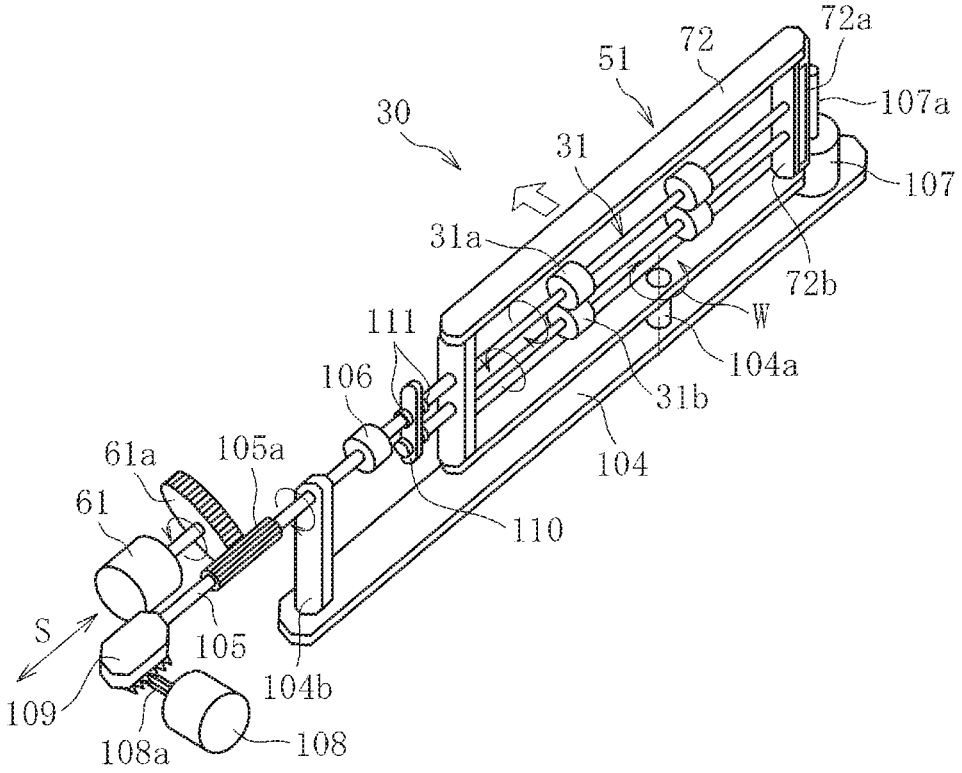
FIG. 4 is a perspective view illustrating the pair of sheet holding rollers and a driving mechanism to drive the pair of sheet holding rollers.

FIG. 4 is a perspective view illustrating the pair of sheet holding rollers 31 and a driving mechanism to drive the pair of sheet holding rollers 31.

As illustrated in FIG. 4, the pair of sheet holding rollers 31 includes multiple pairs of rollers disposed spaced apart from each other in the axial direction thereof. Each of the multiple pairs of rollers of the pair of sheet holding rollers 31 includes a drive roller 31*a* and a driven roller 31*b*. The drive roller 31*a* is rotated by a first drive motor 61 that functions as a drive device (i.e., a first drive device). The driven roller 31*b* is rotated with rotation of the drive roller 31*a*. The pair of sheet holding rollers 31 pivots about the rotation center thereof while holding the sheet P, so as to convey the sheet P.

It is to be noted that, the pair of sheet holding rollers 31 described above has rollers divided in the width direction thereof. However, the structure of a pair of sheet holding rollers is not limited thereto. For example, a pair of sheet holding rollers that is not divided in the axial direction but continuously extends over the whole axial direction thereof may be applied to this disclosure.

The first drive motor 61 is fixed to the frame of the sheet conveying device 30, A drive gear 61*a* is mounted on a motor shaft of the first drive motor 61. The drive gear 61*a* is meshed with a gear 105*a* of a frame side rotary shaft 105 that rotates together with the drive roller 31*a* of the pair of sheet holding rollers 31. According to this configuration, as the first drive motor 61 is driven and rotated, a driving force applied by the first drive motor 61 is transmitted to the drive roller 31*a* of the pair of sheet holding rollers 31 via the drive gear 61*a* and the gear 105*a* of the frame side rotary shaft 105.

The frame side rotary shaft 105 is movably supported by an uprising portion 104*b* of a base 104 of the frame so as to move in the direction S together with movement of the pair of sheet holding rollers 31 in the direction S that corresponds to the width direction of the sheet P, as illustrated in FIG. 4. The gear 105*a* of the frame side rotary shaft 105 is sufficiently extended in the axial direction to retain the meshing with the drive gear 61*a* even when the frame side rotary shaft 105 moves in the direction S.

The frame side rotary shaft 105 and the drive roller 31*a* of the pair of sheet holding rollers 31 are drivingly coupled to each other to transmit the driving force via a coupling 106. The coupling 106 is a shaft coupling such as a constant velocity (universal) joint and a universal joint. With the coupling 106, even if a shaft angle of the pair of sheet holding rollers 31 to the frame side rotary shaft 105 is changed along with rotation of the pair of sheet holding rollers 31 in the direction W in FIG. 4 (i.e., the rotational direction in the plane of sheet conveyance to the direction of angular displacement), a speed of rotation does not change, and therefore the driving force is transmitted successfully.

Both the drive roller 31*a* and the driven roller 31*b* of the pair of sheet holding rollers 31 are rotationally supported by a holding member 72 having a substantially rectangular shape, to respective shafts. Further, the drive roller 31*a* and the driven roller 31*b* are supported by the holding member 72 to be respectively movable in the direction S (i.e., the axial direction) to the holding member 72.

Further, the holding member 72 is rotationally supported about the shaft 104*a* to the base 104 that functions as part of the frame of the sheet conveying device 30 of the image forming apparatus 1. Further, the second drive motor 107 that functions as a second drive device is mounted on one end in the width direction of the base 104. The second drive motor 107 rotates the holding member 72 in the direction W about the shaft 104*a* of the base 104. The second drive motor 107 has a motor shaft 62*a*, on a surface of which a gear is mounted. The gear mounted on the motor shaft 62*a* meshes with a gear 72*a* that is mounted on one end in the width direction of the holding member 72. According to this configuration, as the second drive motor 107 rotates in a forward direction or a reverse direction, the holding member 72 and the pair of sheet holding rollers 31 that is held by the holding member 72 rotates together about the shaft 104*a* in the direction W. Further, a known encoder is mounted on the motor shaft 107*a* of the second drive motor 107, so that the degree of rotation of the pair of sheet holding rollers 31 in the direction W to a reference position of the pair of sheet holding rollers 31 and the direction of rotation of the pair of sheet holding rollers 31 (i.e., the forward direction or the reverse direction) are detected indirectly. Further, a sufficient gap is provided between a supporting part 72*b* disposed at one end of the holding member 72 and the gear 72*a*, so that the respective rotary shafts of the drive roller 31*a* and the driven roller 31*b* do not interfere with the gear 72*a* even if the drive roller 31*a* and the driven roller 31*b* slide to the one end in the width direction.

Further, a third drive motor 108 that functions as a third drive device is disposed on the frame of the sheet conveying device 30 of the image forming apparatus 1 so as to move the pair of sheet holding rollers 31 in the direction S. The third drive motor 108 has a motor shaft 108*a*, on a surface of which a pinion gear is mounted. The pinion gear mounted on the motor shaft 108*a* meshes with a rack gear 109 that is mounted on the other axial end of the frame side rotary shaft 105. The rack gear 109 is rotatably mounted on the frame side rotary shaft 105. According to this configuration, even when the frame side rotary shaft 105 rotates, the rack gear 109 can slide in the direction S without rotating.

Both the drive roller 31*a* and the driven roller 31*b* of the pair of sheet holding rollers 31 are linked to each other via a link 110 so that the drive roller 31*a* and the driven roller 31*b* can move in the direction S together. The link 110 is disposed between the coupling 106 and the holding member 72 to be held by a retaining ring 111 that is mounted on the respective rotary shafts of the drive roller 31*a* and the driven roller 31*b*. According to this configuration, as the third drive motor 108 rotates in the forward direction or the reverse direction, the pair of sheet holding rollers 31 moves in the direction S. Further, a known encoder is mounted on the motor shaft 108*a* of the third drive motor 108, so that the degree of rotation of the pair of sheet holding rollers 31 in the width direction S to a reference position of the pair of sheet holding rollers 31 and the direction of rotation of the pair of sheet holding rollers 31 (i.e., the forward direction or the reverse direction) are detected indirectly.

Now, a description is given of sheet position correction to correct the position of the sheet P, with reference to FIGS. 3A, 3B and 5A through 16.

Figure 5A:
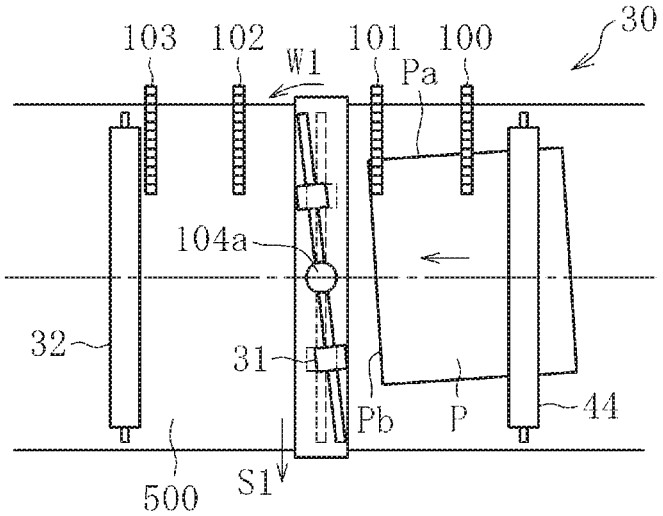
FIG. 5A is a plan view illustrating one step of a process of sheet position correction.
Figure 5B:
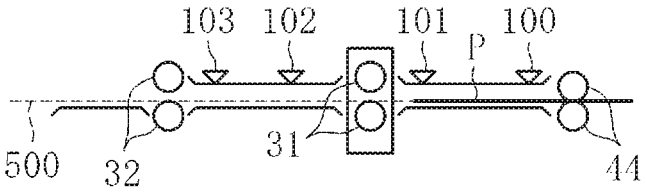
FIG. 5B is a side view illustrating the process of FIG. 5A.

The sheet P fed from any one of the first sheet feeding unit 12, the second sheet feeding unit 13, and the third sheet feeding unit 14 to the sheet conveying device 30 is further conveyed to a downstream side of the sheet conveying direction by the pair of sheet conveying rollers 44, and passes the first CIS 100, as illustrated in FIGS. 3A and 3B. As a leading end Pb of the sheet P arrives at the second CIS 101, as illustrated in FIGS. 5A and 5B, the position of the sheet P is detected (hereinafter, referred to as a "first detection"). Then, based on the result obtained by the first detection, a lateral displacement amount and an angular displacement amount are calculated.

Figure 11:
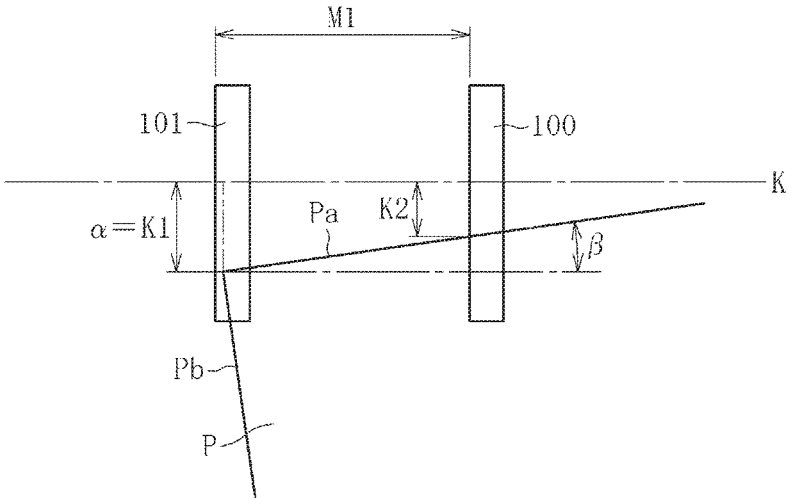
FIG. 11 is a diagram illustrating a position of the sheet for calculating a positional amount of the sheet.

Specifically, the lateral displacement amount of the sheet P based on the result of the first detection is calculated by comparing a position in the width direction of the sheet P detected by the second CIS 101 (i.e., a position of the side edge Pa of the sheet P) and a reference conveyance position K that is indicated by a straight line parallel to the sheet conveying direction illustrated in FIG. 11. Consequently, a distance K1 extending between the position of the sheet P and the reference conveyance position K is calculated as a lateral displacement amount $\alpha$ of the sheet P.

Next, an angular displacement amount of the sheet P is calculated based on a difference of end positions in the width direction of the sheet P detected by the first CIS 100 and the second CIS 101. That is, as illustrated in FIG. 11, when the leading end Pb of the sheet P reaches the second CIS 101, the distance K1 and a distance K2 in the width direction from the reference conveyance position K are detected by the first CIS 100 and the second CIS 101, respectively. Consequently, since a distance M1 in the sheet conveying direction between the first CIS 100 and the second CIS 101 is previously determined, an angular displacement amount $\beta$ to the sheet conveying direction of the sheet P is obtained based on an equation of $\tan \beta = (K1 - K2)/M1$.

Figure 12:
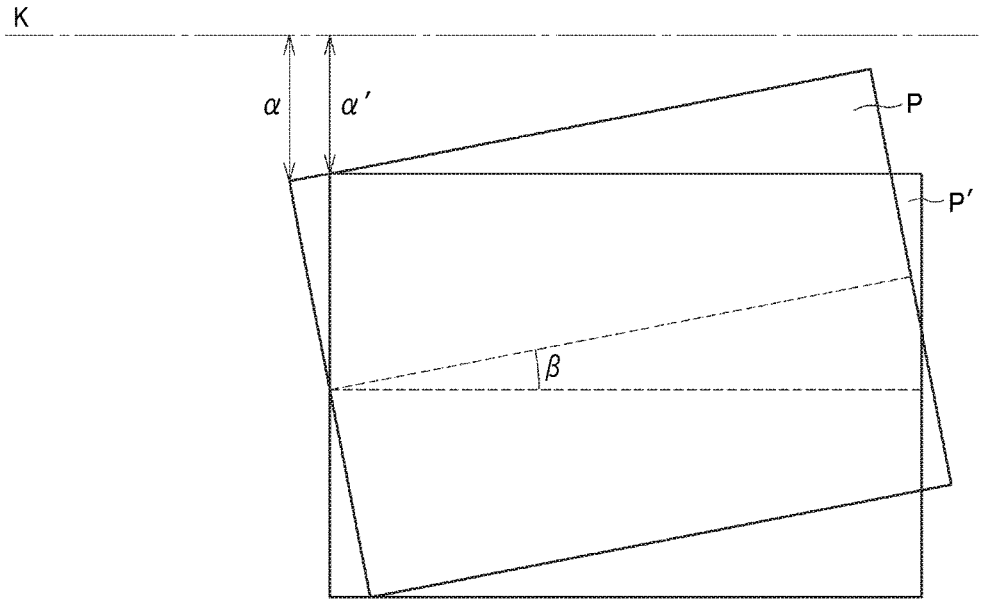
FIG. 12 is a diagram illustrating a lateral displacement amount of the sheet.

Then, based on the lateral displacement amount $\alpha$ of the sheet P and the angular displacement amount $\beta$ of the sheet P obtained as described above, the pair of sheet holding rollers 31 performs a lateral displacement correction of the sheet P and an angular displacement correction of the sheet P, which is hereinafter referred to as a "primary correction." The angular displacement of the sheet P is corrected by the amount of the deviation angle $\beta$. Further, the lateral displacement of the sheet P is corrected based on the lateral displacement amount $\alpha$ and the deviation angle $\beta$. For example, as illustrated in FIG. 12, after correction of the deviation angle $\beta$ has been corrected, the lateral displacement amount $\alpha$ of the sheet P' changes to a lateral displacement amount $\alpha'$. After having been calculated, the lateral displacement amount $\alpha'$ is regarded as the amount of the lateral displacement correction $\alpha'$ to be corrected by the pair of sheet holding rollers 31. (However, the correction amount α' varies depending on a reference position of the correction of the deviation angle β.)

Figure 13:
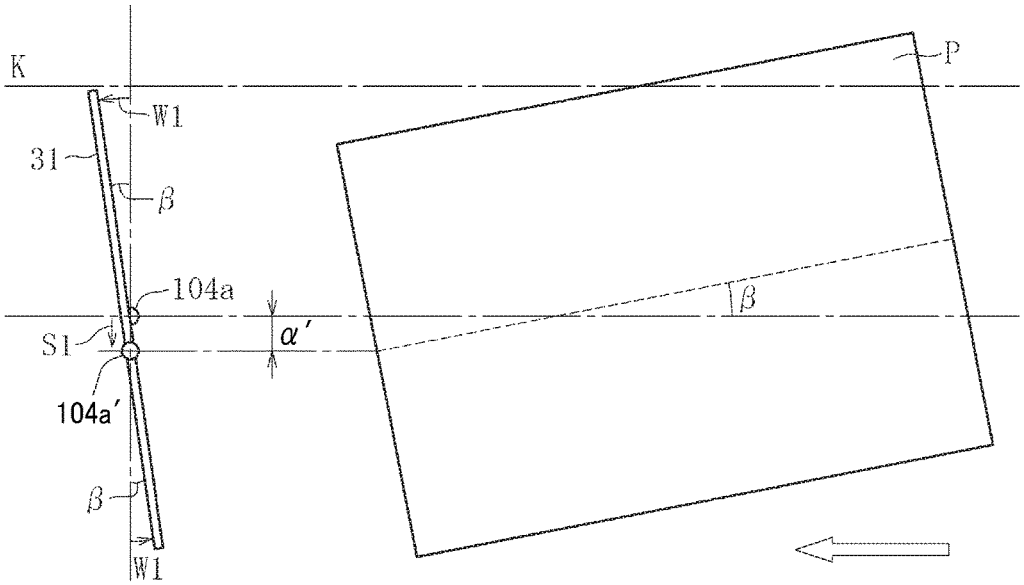
FIG. 13 is a diagram illustrating a pick up and hold operation of the pair of sheet holding rollers.

Here, prior to the first detection, the pair of sheet holding rollers 31 is disposed at the reference position illustrated in FIG. 3A. Before the sheet P reaches the pair of sheet holding rollers 31, the pair of sheet holding rollers 31 perform a pick up and hold operation. The pick up and hold operation is an operation in which the pair of sheet holding rollers 31 moves in the width direction based on the result of the first detection or rotates in the rotational direction of the sheet P within a plane of sheet conveyance, so that the pair of sheet holding rollers 31 comes to a position facing the leading end of the sheet P (to cause the axis of the pair of sheet holding rollers 31 to be parallel to the leading end of the sheet P). Specifically, as illustrated in FIG. 13, before picking up and holding the sheet P, the pair of sheet holding rollers 31 rotates about a shaft 104*a* in a direction indicated by arrow W1 by the deviation angle β and at the same time moves in parallel thereto in a direction indicated by arrow S1 by the distance of the lateral displacement amount α'. With the rotation, the shaft 104*a* moves to the position indicated as a shaft 104*a*'. The above-described pick up and hold operation is performed after the first detection and before the pair of sheet holding rollers 31 holds the sheet P, as illustrated in FIGS. 5A and 5B.

Figure 6A:
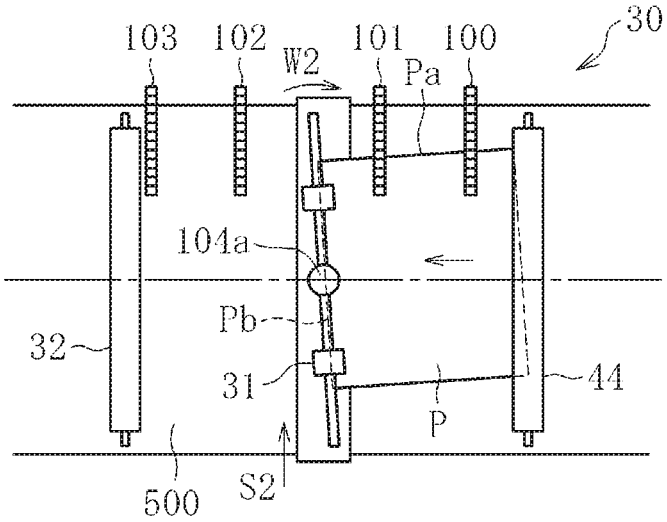
FIG. 6A is a plan view illustrating another subsequent step of the process of sheet position correction.
Figure 6B:
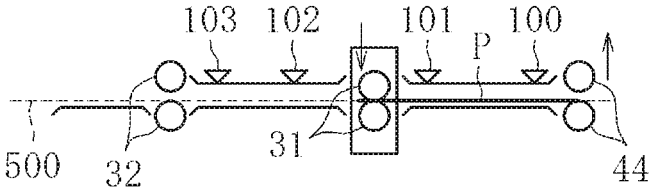
FIG. 6B is a side view illustrating the process of FIG. 6A.

Then, as the leading end Pb of the sheet P reaches the pair of sheet holding rollers 31, the pair of sheet holding rollers 31 holds the sheet P, as illustrated in FIGS. 6A and 6B. At this time, as illustrated in FIG. 6B, the rollers of the pair of sheet conveying rollers 44 disposed upstream from the pair of sheet conveying rollers 44 in the sheet conveying direction separate from each other, so that the rollers of the pair of sheet conveying rollers 44 do not hold the sheet P.

Figure 7A:
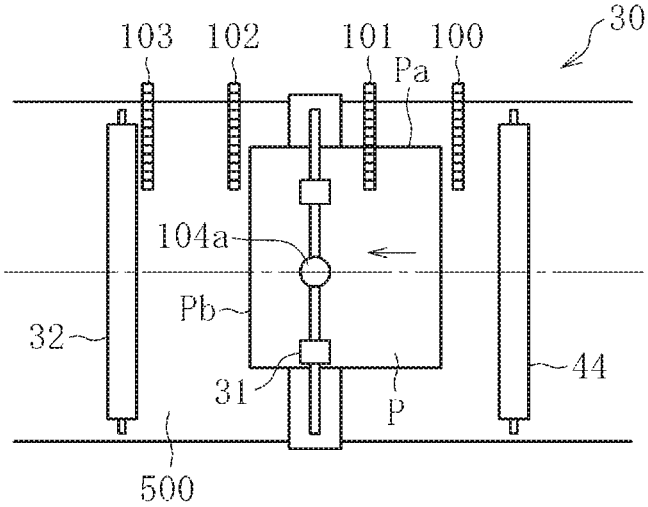
FIG. 7A is a plan view illustrating yet another subsequent step of the process of sheet position correction.
Figure 7B:
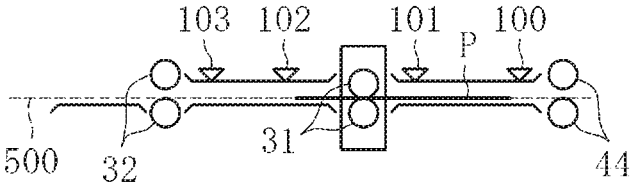
FIG. 7B is a side view illustrating the process of FIG. 7A.

As illustrated in FIG. 6A, when the primary correction begins, the pair of sheet holding rollers 31 rotates, while holding and conveying the sheet P, about the shaft 104*a* in a direction indicated by arrow W2 based on the amount of angular displacement of the sheet P obtained by the result of the first detection. By so doing, the pair of sheet holding rollers 31 corrects the position of the sheet P in the direction of the angular displacement of the sheet P. At the same time, the pair of sheet holding rollers 31 moves in parallel in a direction indicated by arrow S2, so as to correct the position of the sheet P in the width direction. Accordingly, the primary correction performed by the pair of sheet holding rollers 31 is completed, and the position of the sheet P is corrected, as illustrated in FIGS. 7A and 7B.

Figure 14:
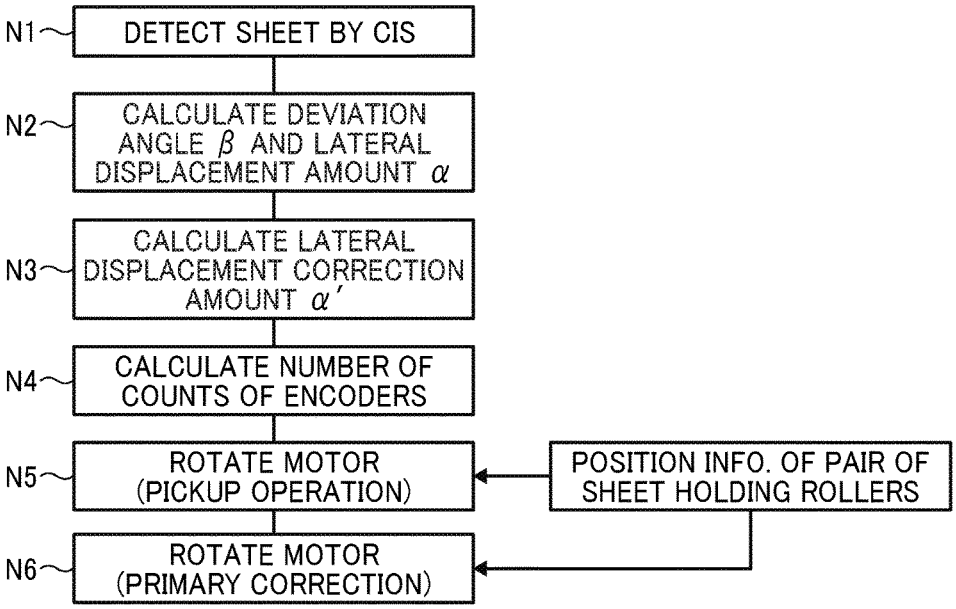
FIG. 14 is a flowchart of a control flow prior to a primary correction.

Now, FIG. 14 is a flowchart of a control flow prior to the above-described primary correction.

Figure 15:
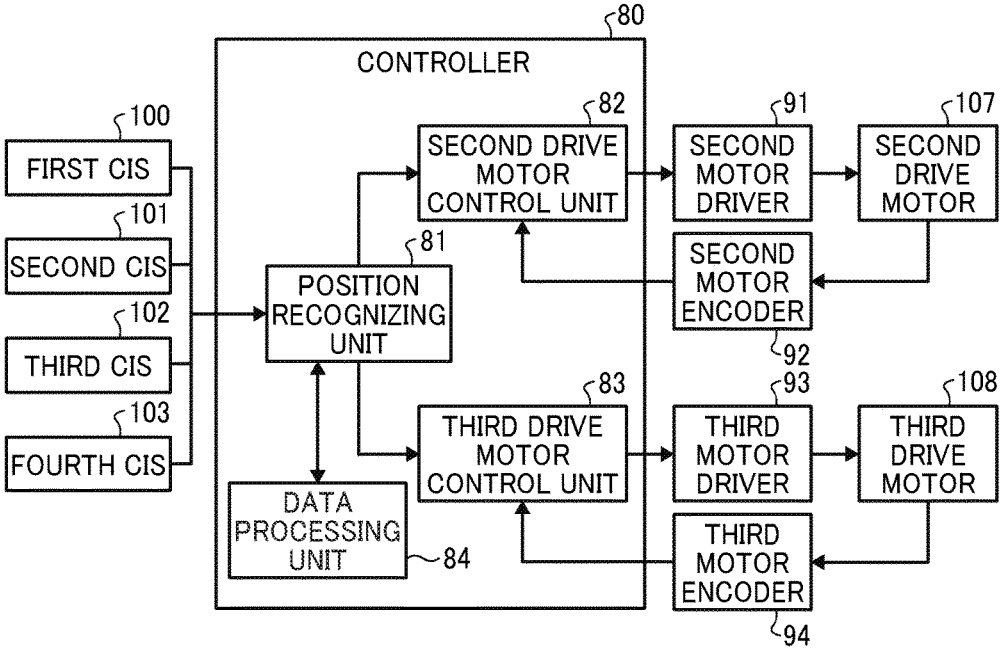
FIG. 15 is a block diagram illustrating a controller that controls the pair of sheet holding rollers.

FIG. 15 is a block diagram illustrating a controller 80 that controls the correction performed by the pair of sheet holding rollers 31.

As illustrated in FIG. 15, a controller 80 includes a position recognizing unit 81, a second drive motor control unit 82 a third drive motor control unit 83, and a data processing unit 84. The position recognizing unit 81 recognizes the position of the sheet P. The second drive motor control unit 82 controls the second drive motor 107 that drives and rotates the pair of sheet holding rollers 31 in the rotational direction of the sheet P (i.e., the direction W) within a plane of sheet conveyance. The third drive motor control unit 83 controls the third drive motor 108 that drives and moves the pair of sheet holding rollers 31 in the width direction (i.e., the direction S). The data processing unit 84 performs storing of the position information of the sheet, obtained by the position recognizing unit 81, and processing the position information.

The position recognizing unit 81 receives respective detection signals of the first CIS 100, the second CIS 101, the third CIS 102 and the fourth CIS 103. The position recognizing unit 81 recognizes the position of the sheet based on the input detection signals, and calculates the positional deviation amounts of the lateral displacement and the angular displacement of the sheet or the positional deviation correction amounts corresponding to these positional deviation amounts.

Further, the second drive motor control unit 82 and the third drive motor control unit 83 control the second drive motor 107 and the third drive motor 108, respectively, based on the positional deviation amounts or the positional deviation correction amounts obtained by the position recognizing unit 81. To be more specific, a second motor driver 91 receives a control signal from the second drive motor control unit 82 and controls the driving of the second drive motor 107, and a third motor driver 93 receives a control signal from the third drive motor control unit 83 and controls the driving of the third drive motor 108.

Further, the driving amounts of the second drive motor 107 and the third drive motor 108 are detected by a second motor encoder 92 and a third motor encoder 94, respectively. The second motor encoder 92 detects the amount of rotations of the second drive motor 107. The third motor encoder 94 detects the amount of rotations of the third drive motor 108. Specifically, since the second motor encoder 92 and the third motor encoder 94 detect the amounts of rotations of the second drive motor 107 and the third drive motor 108, respectively, the amount of movement of the pair of sheet holding rollers 31 in the width direction (i.e., the direction S9 and the amount of rotation of the pair of sheet holding rollers 31 in the rotational direction (i.e., the direction W) within a plane of sheet conveyance are detected indirectly.

As illustrated in FIG. 14 in the control flow from the first detection to the primary correction, the first CIS 100 and the second CIS 101 detect the position of the sheet P, in step N1. Then, the position recognizing unit 81 calculates a lateral displacement amount α and an angular displacement amount β of the sheet P based on the detection signals from the first CIS 100 and the second CIS 101, in step N2. Then, based on the lateral displacement amount α and the angular displacement amount β calculated by the position recognizing unit 81 in step N2, the lateral displacement correction amount α' is calculated in step N3. Accordingly, the correction amount of the primary correction (i.e., the angular displacement correction amount β and the lateral displacement correction amount α') are determined.

Based on the detected correction amounts, the second motor encoder 92 and the third motor encoder 94 (see FIG. 15) calculate the number of counts thereof; in step N4.

According to the determined number of counts of the second motor encoder 92 and the third motor encoder 94, the second motor driver 91 drives the second drive motor 107 and the third motor driver 93 drives the third drive motor 108, so that the holding member 72 and the rack gear 109 illustrated in FIG. 4 rotate in the direction W or move in the direction Sin the drawing. Accordingly, the pick up and hold operation is performed, in step N5. Then, after the pair of sheet holding rollers 31 has held the sheet P, the second drive motor 107 and the third drive motor 108 are driven to rotate or move the pair of sheet holding rollers 31 in a direction opposite the direction of the pick up and hold operation while holding and conveying the sheet P, in step N6. When the pair of sheet holding rollers 31 performs the pick up and hold operation and the primary correction, the second motor encoder 92 and the third motor encoder 94 feed back the position information of the pair of sheet holding rollers 31 continuously. Accordingly, the pair of sheet holding rollers 31 is controlled to move by the determined amount of movement. According to the above-described operation, the position of the pair of sheet holding rollers 31 after completion of the primary correction further approaches the reference position. However, it is not determined that the pair of sheet holding rollers 31 returns to the reference position by performing the secondary correction, which is described below.

As described above, in the present embodiment, the positional correction of the sheet P (i.e., the primary correction) is performed based on the lateral and angular displacement amounts of the sheet P obtained by the detection result of the first CIS 100 and the second CIS 101. However, there is a case that the primary correction alone is not sufficient to achieve the accuracy in expected position of the sheet P.

Specifically, after the first detection, a force is applied to the sheet P by the pair of sheet holding rollers 31 when the sheet P is held by the pair of sheet holding rollers 31. Therefore, it is likely that a further positional deviation is generated to the position of the sheet P. Further, when the pair of sheet holding rollers 31 corrects the position of the sheet P or conveys the sheet P toward the downstream side in the sheet conveying direction, it is also likely that a further positional deviation is generated to the position of the sheet P. Further, it is also likely that a correction error is generated in the primary correction.

In order to address these inconveniences, the sheet conveying device 30 according to the present embodiment performs a secondary correction after the primary correction so as to further correct the position of the sheet P.

Now, a description is given of the secondary correction.

Figure 8A:
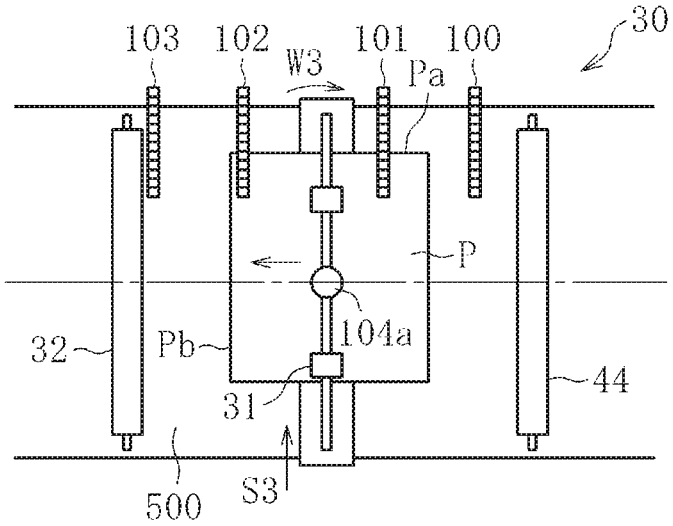
FIG. 8A is a plan view illustrating yet another subsequent step of the process of sheet position correction.
Figure 8B:
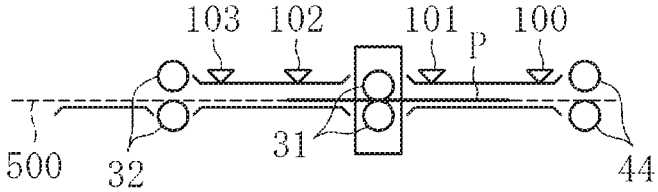
FIG. 8B is a side view illustrating the process of FIG. 8A.

After the primary correction, as the leading end Pb of the sheet P arrives at the third CIS 102, as illustrated in FIGS. 8A and 8B, the position of the sheet P is detected again by the second CIS 101 and the third CIS 102 (hereinafter, referred to as a "second detection"). Then, based on the result obtained by the second detection, lateral and angular displacement amounts of the sheet P are calculated.

The lateral and angular displacement amounts of the sheet P based on the second detection are calculated by the same steps as taken in the first detection, based on the detection results obtained by the upstream side OS and the downstream side CIS. That is, the lateral displacement amount $\alpha$ is obtained based on the position of the sheet P in the width direction obtained by the third CIS 102 (i.e., the position of the side edge Pa in the width direction). Further, the angular displacement amount of the sheet P is calculated based on the respective positions in the width direction of the sheet P obtained by the second CIS 101 and the third CIS 102 and the distance between the second CIS 101 and the third CIS 102 in the sheet conveying direction. (In the second detection, the position of the sheet P is detected by the second CIS 101 that is replaced by the first CIS 100 used in the first detection and the third CIS 102 that is replaced by the second CIS 101 used in the first detection.)

Then, based on the lateral and angular displacement amounts of the sheet P calculated based on the detection result obtained through the second detection, the pair of sheet holding rollers 31 moves, while conveying the sheet P, in a direction indicated by arrow S3 in FIG. 8A, and rotates about the shaft 104*a* in a direction indicated by arrow W3 in FIG. 8A. By so doing, the secondary correction is performed.

Figure 16:
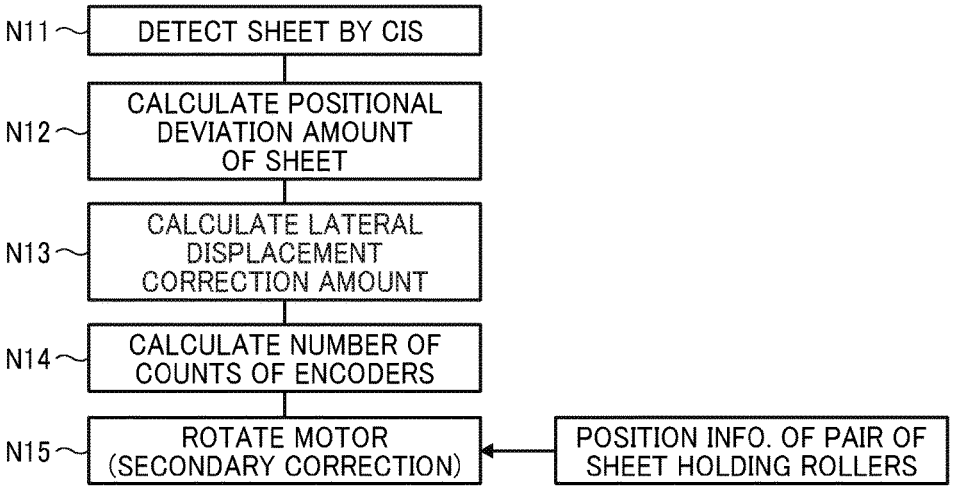
FIG. 16 is a flowchart of a control flow of a secondary correction.

FIG. 16 is a flowchart of a control flow of the secondary correction.

In the secondary correction, the second CIS 101 and the third CIS 102 detect the sheet P, in step N11. Then, with the same steps as the primary correction, the position recognizing unit 81 calculates the positional deviation amounts (i.e., the lateral and angular displacement amounts) of the sheet P, in step N12. Then, respective lateral and angular displacement correction amounts are calculated based on the calculated lateral and angular displacement amounts, in step N13. The second motor encoder 92 and the third motor encoder 94 then calculate the respective numbers of counts thereof, in step N14. Thereafter, the second motor driver 91 and the third motor driver 93 drive the second drive motor 107 and the third drive motor 108, respectively, according to the respective numbers of counts of the second motor encoder 92 and the third motor encoder 94, and then the pair of sheet holding rollers 31 performs the secondary correction, in step N15.

During the secondary correction, the second CIS 101 and the third CIS 102 continuously detect the position information of the sheet P after the start of the secondary correction. Then, the positional deviation amount of the sheet P is detected based on the position information and is fed back to the controller. Accordingly, the lateral displacement correction amount of the sheet P and the angular displacement correction amount of the sheet P (i.e., the respective numbers of counts of the second motor encoder 92 and the third motor encoder 94) are updated continuously. By performing the feedback control as described above, the positional deviation of the sheet P that may be generated from the first detection to the second detection and the correction error in the secondary correction can be reduced, and therefore the correction can be performed with higher accuracy. However, the secondary correction may be performed without the feedback control. Specifically, the secondary correction may be performed for just one time based on the correction amount calculated on arrival of the leading end of the sheet P at the third CIS 102.

Figure 9A:
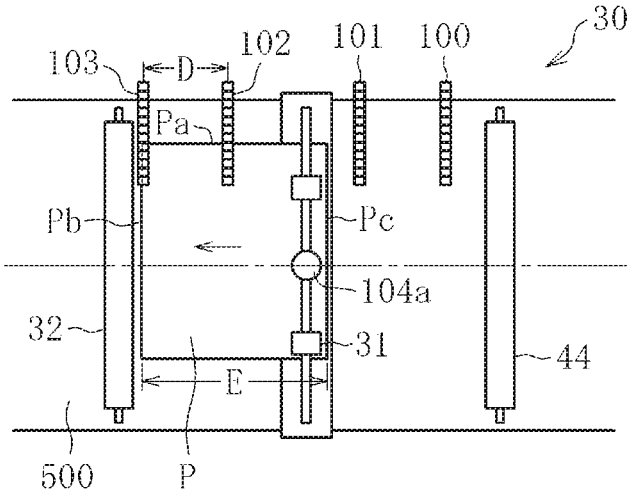
FIG. 9A is a plan view illustrating yet another subsequent step of the process of sheet position correction.
Figure 9B:
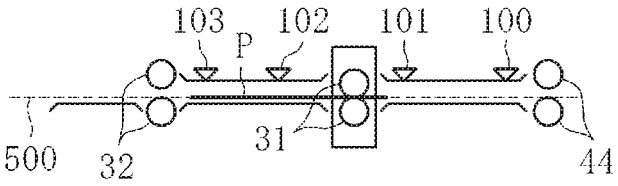
FIG. 9B is a side view illustrating the process of FIG. 9A.

However, in the configuration in which two CISs aligned along the sheet conveying direction detect an angular displacement amount of a sheet, after a trailing end Pc of the sheet P has passed the second CIS 101, as illustrated in FIGS. 9A and 9B, the second CIS 101 and the third CIS 102 cannot detect the position of the sheet P for calculating the angular displacement amount. In other words, in that case, the second. CIS 101 and the third CIS 102 cannot perform the second detection. Since there is a case that a further positional deviation of the sheet P is also generated during conveyance of the sheet P by the pair of sheet holding rollers 31, in order to perform the position correction with higher accuracy the position of the sheet P needs to be detected even after the trailing end of the sheet P has passed the second CIS 101.

Figure 27:
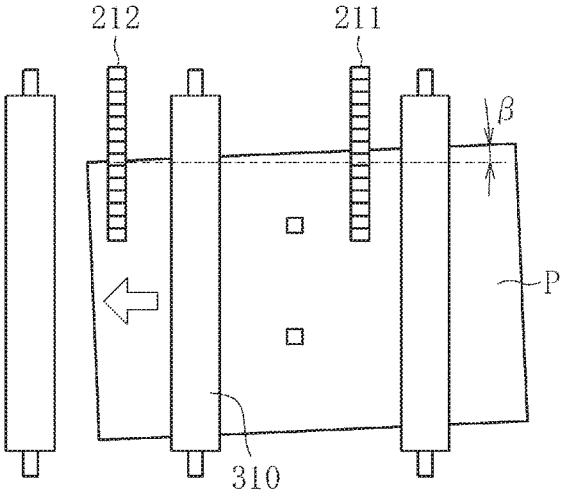
FIG. 27 is a schematic diagram rating a comparative sheet conveying device.

Now, a description is given of a comparative sheet conveying device including two CISs, with reference to FIG. 27.

In order to detect a positional deviation amount generated during conveyance of a sheet by a pair of sheet holding rollers, a comparative sheet conveying device illustrated in FIG. 27 includes a pair of sheet holding rollers 310, a CIS 211 disposed upstream from the pair of sheet holding rollers 310 in a sheet conveying direction, and another CIS 212 disposed downstream from the pair of sheet holding rollers 310 in the sheet conveying direction. The CISs 211 and 212 detect the position of the sheet P. According to this configuration, the CISs 211 and 212 detect the position of a side end (i.e., one end in the width direction) of the sheet P, and therefore the pair of sheet holding rollers 310 can detect the positional deviation of the sheet P during conveyance.

When the CISs 211 and 212 disposed adjacent to each other in the sheet conveying direction detect an angular displacement amount (skew amount) β of the sheet P, the CISs 211 and 212 need to obtain position information of the sheet P while the sheet P is passing by both of the CISs 211 and 212 (see FIG. 27). Therefore, after the trailing end of the sheet P has passed the CIS 211, the angular displacement amount β cannot be obtained. Therefore, the CISs 211 and 212 cannot detect the positional deviation amount of the sheet P generated during sheet conveyance by the pair of sheet holding rollers 310 or in a downstream side from the pair of sheet holding rollers 310 sufficiently (over a wide range).

In order to address this inconvenience, another CIS is provided further downstream in the sheet conveying direction, so that a range capable of detecting the positional deviation becomes greater. However, even though such a new sensor is added, depending on the distance between the new sensor and the pair of sheet holding rollers in the sheet conveying direction (when the new sensor and the pair of sheet holding rollers are separated and the distance is relatively long) and the length of the sheet P in the sheet conveying direction (when the length of the sheet P is relatively short), if the sensor disposed at the downstream side detects the positional deviation of the sheet P, it is likely that the trailing end of the sheet P is immediately before passing the pair of sheet holding rollers or has passed the pair of sheet holding rollers at the time of detection. In such a case, the pair of sheet holding rollers cannot correct the position of the sheet. Even if the pair of sheet holding rollers can correct the position of the sheet, a sufficient position correction time cannot be obtained. Accordingly, the position correction of the sheet becomes insufficient.

As described above, it has been difficult to achieve both detection of the positional deviation amount of a conveyance target media (i.e., a sheet) over a wide range on the downstream side from a position corrector (i.e., the pair of sheet holding rollers) in the sheet conveying direction and a sufficient period of time to perform the position correction of the sheet based on the detected positional deviation amount of the sheet. In other words, the detection of the position of the sheet and the sufficient period of time to perform the position correction have been in a trade-off relation.

By contrast, the sheet conveying device 30 according to the present embodiment, even after the trailing end of the sheet P has passed the second CIS 101, the position of the sheet P is detected again (hereinafter, referred to as a "third detection").

In the third detection, after the trailing end Pc of the sheet P has passed the second CIS 101, as illustrated in FIGS. 9A and 9B, the position of the sheet P is detected by the third CIS 102 and the fourth CIS 103. Then, based on the result obtained by the third detection, an angular displacement amount of the sheet P is calculated. The angular displacement amount of the sheet P based on the third detection are calculated by the same steps as taken in the first detection and the second detection. Further, the position recognizing unit 81 calculates the angular displacement amount of the sheet P based on the respective positions in the width direction of the sheet P obtained by the third CIS 102 and the fourth CIS 103 and the distance between the third CIS 102 and the fourth CIS 103. Further, it is preferable that a distance D in the sheet conveying direction between the third CIS 102 and the fourth CIS 103 is smaller (shorter) than at least a minimum length E of the sheet P in the sheet conveying direction, so that the third detection can be performed to a sheet P having the minimum conveyable size in the sheet conveying direction, as illustrated in FIG. 9A.

Figure 10A:
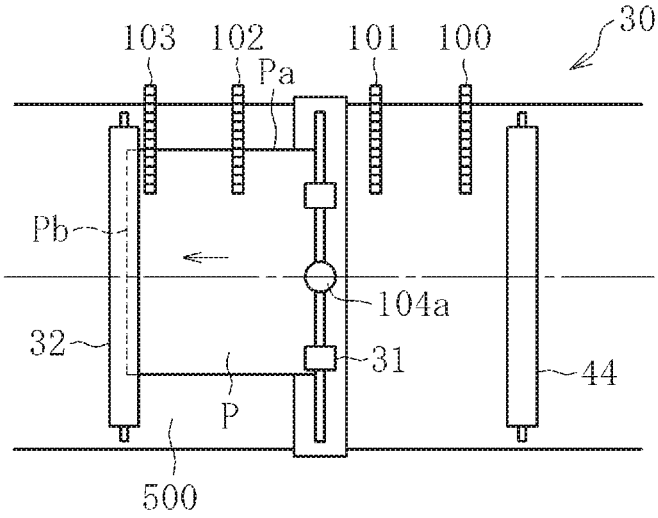
FIG. 10A is a plan view illustrating yet another subsequent step of the process of sheet position correction.
Figure 10B:
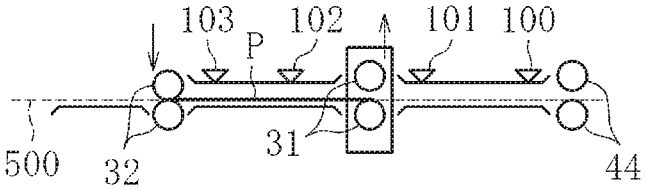
FIG. 10B is a side view illustrating the process of FIG. 10A.

It is preferable that the positional deviation information of the sheet based on the third detection is possibly used for the sheet position correction of the sheet P. However, the sheet position correction is within a time constraint, that is, the sheet position correction is performed before leading end Pb of the sheet P is held by the pair of timing rollers 32 that is disposed downstream from the pair of sheet holding rollers 31 in the sheet conveying direction, as illustrated in FIG. 10. Specifically, in a case in which the fourth CIS 103 is disposed in the vicinity of the upstream side from the pair of timing rollers 32 as the present embodiment, leading end Pb of the sheet P reaches the pair of timing rollers 32 immediately after passing the fourth CIS 103. Therefore, it is significantly difficult to correct the position of the sheet P by using the information of the positional deviation information of the sheet P based on the third detection. By contrast, in a case in which similar type sheets are conveyed, the positional deviation amounts of the sheets are assumed to be substantially identical to each other. Due to the above-described circumstances, the positional deviation information of the sheet P based on the third detection is not used for the sheet position correction of the sheet after the third detection but is used with the feedback control for the sheet position correction of a subsequent sheet.

By contrast, the position of the sheet P in the width direction is continuously detected by the third CIS 102 from immediately after the trailing end Pc of the sheet P has passed the second CIS 101. Accordingly, in a case in which there is a sufficient time to perform the sheet position correction after the trailing end Pc of the sheet P has passed the second CIS 101, the sheet position correction of the sheet P that is being conveyed may be performed based on the lateral displacement amount of the sheet P obtained by the detection result of the third CIS 102. If there is not a sufficient time to perform the sheet position correction, the lateral displacement amount (in the width direction) of the sheet P that is calculated based on the detection result of the third. CIS 102 can be used with the feedback control for the sheet position correction of a subsequent sheet to be conveyed.

Figure 17:
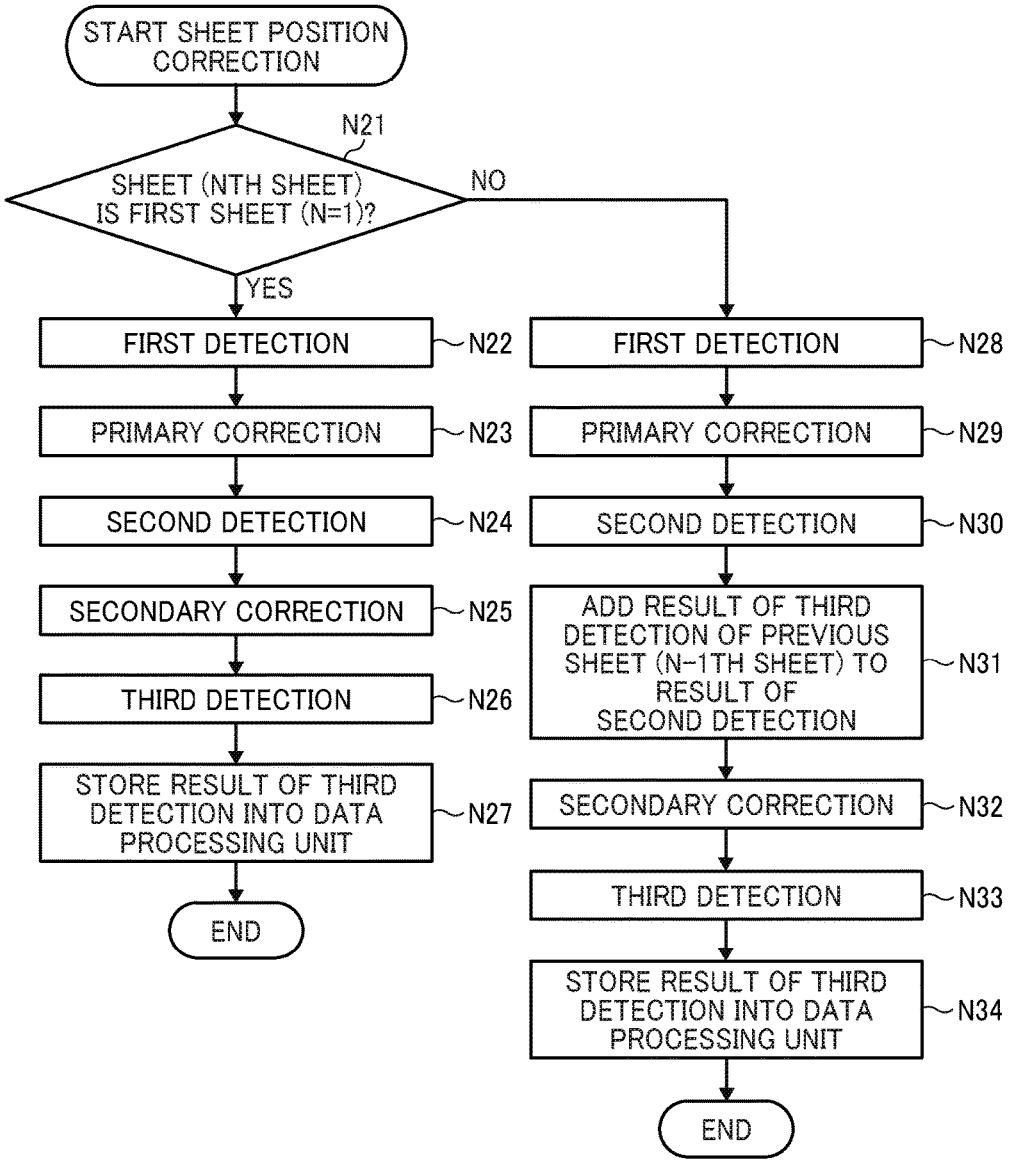
FIG. 17 is a flowchart of a feedback control of a preceding sheet and a subsequent sheet.

Now, a description is given of the processes of sheet conveyance by performing the feedback control to a subsequent sheet with the position information detected with a preceding sheet, with reference to FIG. 17.

FIG. 17 is a flowchart of the feedback control of a preceding sheet and a subsequent sheet.

In the flowchart of FIG. 17, as the sheet position correction starts, the controller 80 determines the sheet to be conveyed is the first sheet (N=1), in step N21. When the first sheet (N=1) is conveyed (YES in step N21), the first CIS 100 and the second CIS 101 perform the first detection, in step N22, and the primary correction is performed based on the result of the first detection, in step N23. Then, the second CIS 101 and the third CIS 102 perform the second detection, in step N24, and the secondary correction is performed based on the result of the second detection, in step N25. Consequently, the second detection continues until the trailing end of the sheet passes the second CIS 101. Thereafter, the third CIS 102 and the fourth CIS 103 perform the third detection, in step N26. The position information of the sheet (i.e., the positional deviation amount of the sheet) obtained based on the third detection is stored in the data processing unit 84, in step N27, and the sheet position correction completes.

By contrast, when a second sheet is conveyed (NO in step N21), the same procedures are taken on the first sheet in the first detection and the second detection. Specifically, the first CIS 100 and the second CIS 101 perform the first detection, in step N28, and the primary correction is performed based on the result of the first detection, in step N29. Then, the second CIS 101 and the third CIS 102 perform the second detection on the second sheet, in step N30. After step N30, the positional deviation amount of the first sheet obtained through the third detection of the first sheet is retrieved from the data processing unit 84 and is added to the positional deviation amount of the second sheet Obtained through the second detection of the second sheet, in step N31.

In step N32, the secondary correction is performed based on a sum of the positional deviation amount obtained through the third detection of the first sheet and the positional deviation amount obtained through the second detection of the second sheet in step N31. Specifically, in the secondary correction of the second sheet, the sheet position correction is performed based on the position information (i.e., the positional deviation amount) detected on the second sheet until the trailing end of the second sheet passes the second CIS 101, and is performed based on the combined position information of the above-described position information of the second sheet and the position information (i.e., the positional deviation amount) of the first sheet detected through the third detection of the first sheet after the trailing end of the second sheet has passed the second CIS 101.

It is to be noted that the positional deviation amount of the first sheet may be added to the positional deviation amount of the second sheet by the position recognizing unit 81 or any other processing unit.

As described above, in the secondary correction of the second sheet, the positional deviation amount of the first sheet obtained through the third detection of the first sheet is added to the positional deviation amount of the second sheet. By so doing, even without actually detecting the positional deviation amount of the second sheet to be generated after the second detection (i.e., after the trailing end of the sheet has passed the second CIS 101), the sheet position correction can be performed including this positional deviation amount of the second sheet. Accordingly, the time to be taken for detecting the position information of the second sheet can be reduced, and therefore the sheet position correction can be performed based on more position information. Accordingly, the sheet position correction can be performed reliably with a sufficient time, thereby achieving a more accurate sheet position correction.

Consequently, similar to the processes on the first sheet, the second detection continues on the second sheet until the trailing end of the second sheet passes the second CIS 101. Thereafter, the third CIS 102 and the fourth CIS 103 perform the third detection, in step N33. The position information of the second sheet (i.e., the positional deviation amount of the second sheet) obtained based on the third detection is stored in the data processing unit 84, in step N34, and the sheet position correction completes.

Subsequently, when a third sheet is conveyed (NO in step N21), the same procedures are taken on the second sheet. Specifically, the first detection in step N22, the primary correction in step N23, and the second detection in step N24. Then, the secondary correction is performed in step N25, with a sum of the positional deviation amount of the third sheet obtained in the second detection and the positional deviation amount of the second sheet based on the result of the third detection of the second sheet that is retrieved from the data processing unit 84. Similar to the second sheet, the third detection is performed on the third sheet, in step N26. Then, the position information of the third sheet (i.e., the positional deviation amount of the third sheet) obtained based on the third detection is stored in the data processing unit 84, in step N27, and the sheet position correction completes. Subsequently, when a subsequent sheet (i.e., a fourth sheet and afterwards) is conveyed (NO in step N21), the same procedures are taken as the second sheet and the third sheet to perform the sheet position correction. Accordingly, the secondary correction of each subsequent sheet, which is an Nth sheet corresponding to the second sheet and afterwards, is performed by adding the result of the third detection of a sheet immediately before the Nth sheet, which is an N−1th sheet. By so doing, similar to the above-described sheet position correction of the second and third sheets, a more accurate sheet position correction can be performed with a sufficient time.

In the above-described embodiment, the positional deviation amount of each sheet obtained through the third detection is added to the positional deviation amount of a subsequent sheet immediately after each sheet. However, the process of the sheet position correction is not limited thereto. For example, the third detection may be performed on the first sheet alone and the positional deviation amount of the first sheet based on the result of the third detection of the first sheet may be added to the positional deviation amount of the second sheet or any sheet afterwards. Further, the positional deviation amount of a preceding sheet to be added to the positional deviation amount of a subsequent sheet may be either one of the angular displacement amount and the lateral displacement amount or both of the angular displacement amount and the lateral displacement amount.

Figure 18:
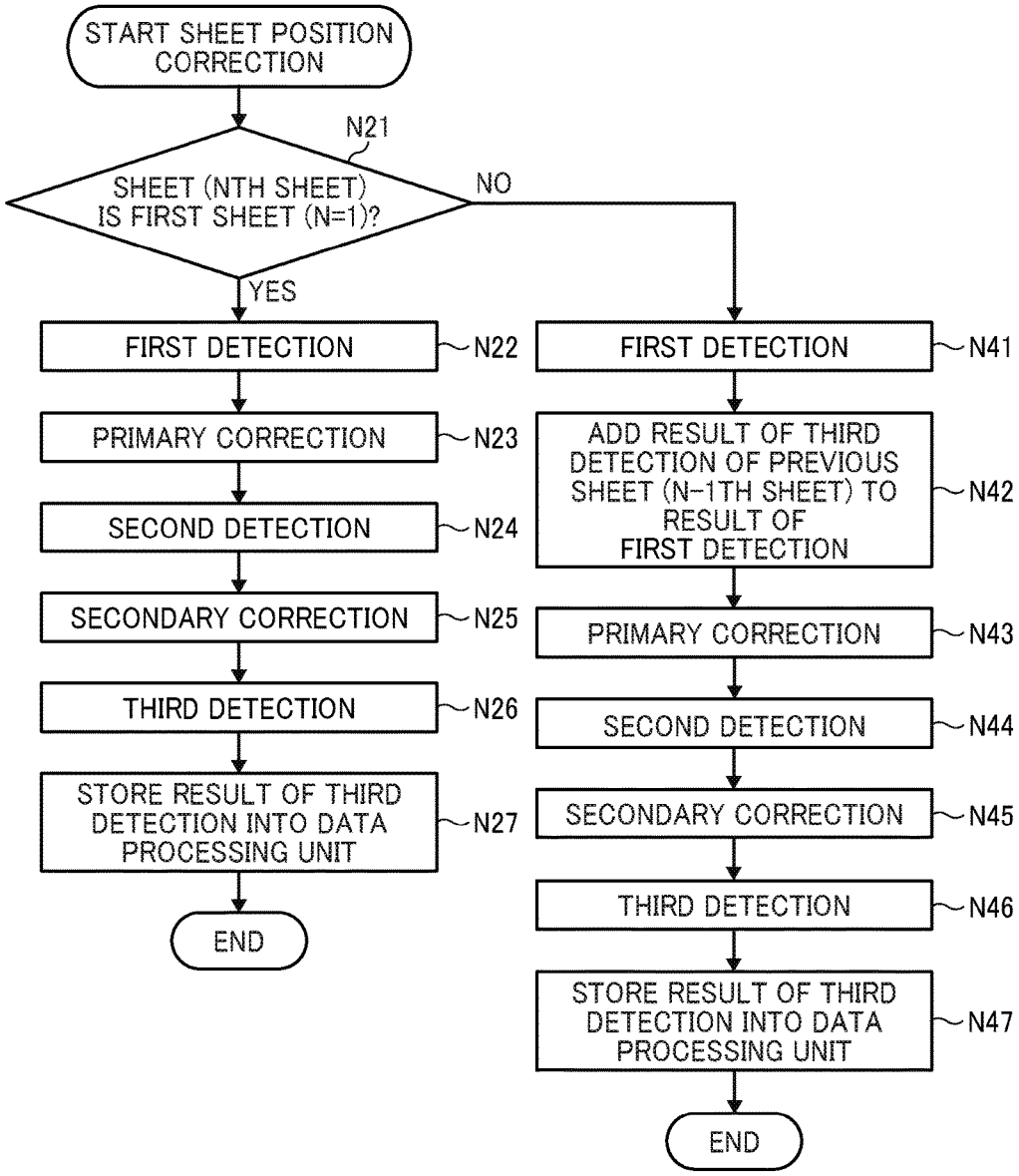
FIG. 18 is a flowchart of another feedback control of the preceding sheet and the subsequent sheet.

As illustrated in FIG. 18, the positional deviation amount of the preceding sheet obtained through the third detection of the preceding sheet may be added to the result of the first detection of the subsequent sheet, which is step N42 in FIG. 18. In this case, the pair of sheet holding rollers 31 performs the pick up and hold operation by a sum of the positional deviation amount of the preceding sheet obtained through the third detection of the preceding sheet and the positional deviation amount of the subsequent sheet obtained through the first detection of the subsequent sheet. Thereafter, the pair of sheet holding rollers 31 is moved in the direction opposite the movement of the pick up and hold operation. By so doing, the sheet position correction (i.e., the primary correction) of the subsequent sheet is performed based on the positional deviation amount of the subsequent sheet together with the third detection of the preceding sheet, in step N43. Then, the second detection in step N44, the secondary correction in step N45, and the third detection in step N46, which are the same operations as steps N30, 32 and 33 in the flowchart of FIG. 17. Then, the position information of the subsequent sheet (i.e., the positional deviation amount of the subsequent sheet) obtained based on the third detection is stored in the data processing unit 84, in step N47, similar to step N34 in the flowchart of FIG. 17, and the sheet position correction completes.

Figure 19:
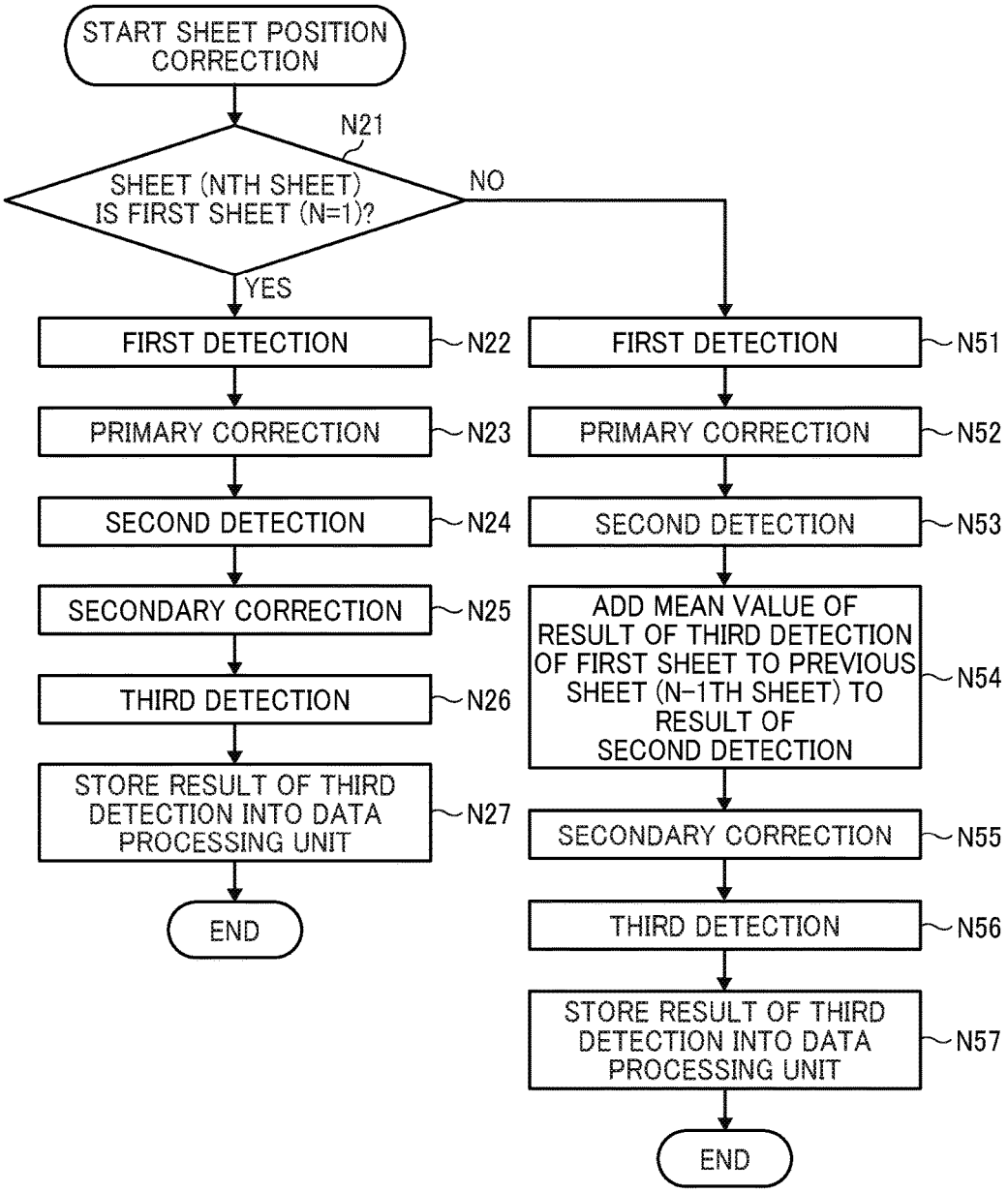
FIG. 19 is a flowchart of yet another feedback control of the preceding sheet and the subsequent sheet.

Now, FIG. 19 is a flowchart of yet another feedback control of the preceding sheet and the subsequent sheet.

As illustrated in FIG. 19, the positional deviation amount of the preceding sheet to be added to the position correction of the subsequent sheet (i.e., the Nth sheet) such as the second sheet and afterwards may be a mean value of the results of the third detection (i.e., the positional deviation amounts) of the first sheet to the previous sheet (i.e., the N−1th sheet), in step N54. Specifically, after the first detection in step N51, the primary correction in step N52, and the second detection in step N53, the mean value of the results of the third detection of the first sheet to the previous sheet is added to the result of the second detection of the subsequent sheet, in step N54. The above-described mean value as the result of the third detection is calculated by the data processing unit 84 in which the results of the third detection of each sheet are stored.

It is to be noted that a mean value of the results of the third detection is added to the result of the second detection of the subsequent sheet in the flowchart of FIG. 19 but the control flow is not limited thereto. For example, the mean value of the results of the third detection may be added to the result of the first detection of the subsequent sheet. Thereafter, the secondary correction and the third detection are performed in step N55 and step N56, respectively. Then, the position information of the subsequent sheet (i.e., the positional deviation amount of the subsequent sheet) obtained based on the third detection in step N56 is stored in the data processing unit 84, in step N57 similar to step N34 in the flowchart of FIG. 17 and step N47 in the flowchart of FIG. 18, and the sheet position correction completes.

Figure 20A:
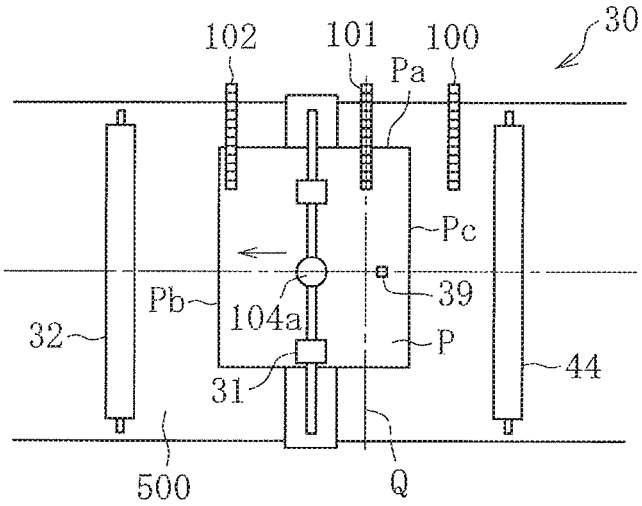
FIG. 20A is a plan view illustrating the sheet conveying device including a trailing end detection sensor provided instead of a fourth CIS.
Figure 20B:
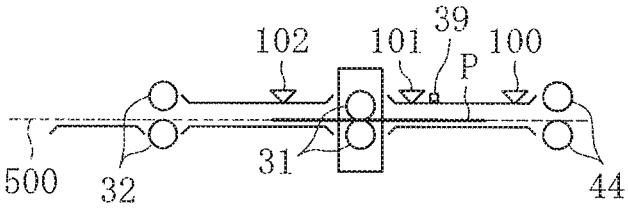
FIG. 20B is a side view illustrating the sheet conveying device of FIG. 20A.
Figure 21:
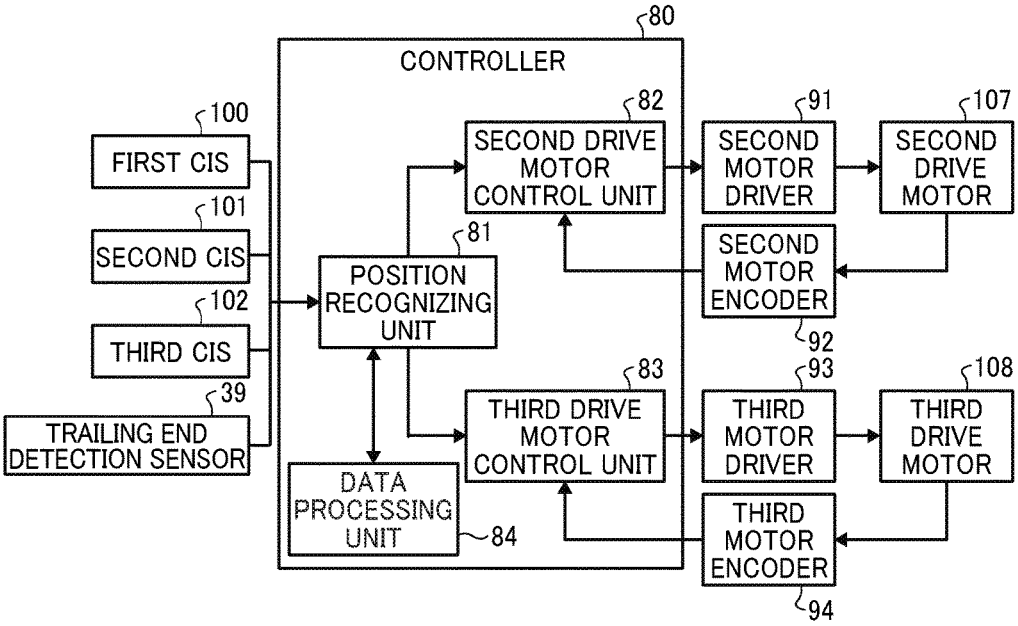
FIG. 21 is a block diagram illustrating a configuration of the sheet conveying device of FIG. 20.

Further, as the configuration illustrated in FIGS. 20A, 20B and 21, the above-described feedback control may be performed with the first CIS 100, the second CIS 101 and the third CIS 102 and without using the fourth CIS 103. In this configuration, as the first sheet P is conveyed, the first CIS 100 and the second CIS 101 performs the first detection of the first sheet P, which is similar to the above-described embodiments. Based on the result of the first detection, the primary correction is performed on the first sheet P. Then, on arrival of the leading end of the first sheet P to the third CIS 102, the second CIS 101 and the third CIS 102 perform the second detection, accordingly. Based on the result of the second detection, the secondary correction is performed on the first sheet P. However, immediately before the trailing end Pc of the first sheet P passes the second CIS 101, the second detection of the first sheet P and the secondary correction of the first sheet P based on the result of the second detection finishes. Thereafter, the second CIS 101 and the third CIS 102 perform the third detection to obtain the position information of the first sheet P, so as to use the position information for the sheet position correction of the second sheet P.

Here, in the configuration illustrated in FIGS. 20A, 20B and 21, a trailing end detection sensor 39 is employed to detect the trailing end Pc of the sheet P. Specifically, the trailing end detection sensor 39 functions as a member to determine whether the trailing end Pc of the sheet P is brought to a stage immediately before passing the second CIS 101. The information detected by the trailing end detection sensor 39 is sent to the position recognizing unit 81, as illustrated in FIG. 21. By so doing, the state of the sheet Pin which the trailing end Pc of the sheet P comes immediately before passing the second CIS 101 is grasped.

Further, as illustrated in FIGS. 20A and 20B, the trailing end detection sensor 39 is disposed upstream from the second CIS 101 in the sheet conveying direction, that is, at a position close to the upstream side of the sheet conveying direction from the second CIS 101 (i.e., a position Q indicated by a broken line in FIG. 20A. It is preferable that the trailing end detection sensor 39 is a reflective optical sensor having better sensitivity to the trailing end of a sheet than a CIS with good responsiveness. Accordingly, by employing the trailing end detection sensor 39 having good responsiveness, passing of the trailing end of a sheet can be detected instantly, and therefore the above-described switching control from the second detection to the third detection can be easily performed.

Similarly, a switching control from the second detection to the third detection for the second sheet and afterwards are performed in the same way as the switching control for the first sheet.

As described above, by timely switching the second detection and the third detection with the trailing end detection sensor 39, even in the configuration having three CISs, which are the first CIS 100, the second. CIS 101 and the third CIS 102, the feedback control for the subsequent sheet can be performed. In addition, since the number of CISs can be reduced, thereby achieving a reduction in cost of the image forming apparatus 1. However, the configuration of FIGS. 20A, 20B and 21 performs the third detection for a significantly short distance from a time when the trailing end detection sensor 39 detects the trailing end Pc of the sheet P to a time when the trailing end Pc of the sheet P passes the second CIS 101. Therefore, the third detection cannot be performed over a long distance along the sheet conveying direction. However, in a case in which the positional deviation tends to be generated at a constant rate after the trailing end Pc of the sheet P has passed the second CIS 101, the positional deviation amount of the sheet P to be generated after passing the second CIS 101 can be predicted to some extent. Therefore, by performing the feedback control of the subsequent sheet based on the positional deviation amount of the preceding sheet obtained by the third detection and the expected positional deviation amount, the sheet position correction can be performed while the certain accuracy thereof is being maintained.

Figure 22A:
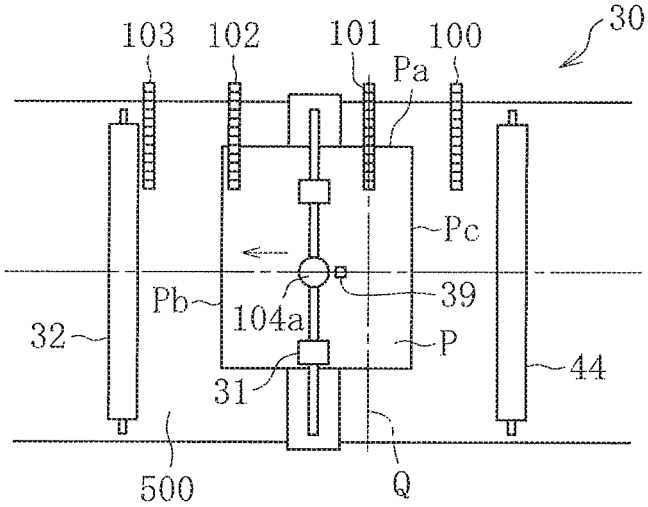
FIG. 22A is a plan view illustrating the sheet conveying device including four CISs and the trailing end detection sensor.
Figure 22B:
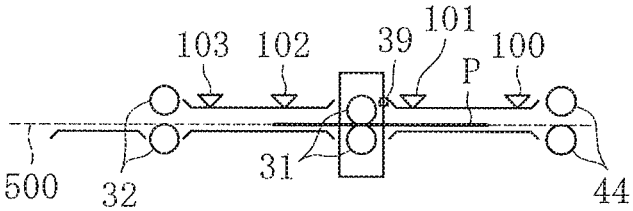
FIG. 22B is a side view illustrating the sheet conveying device of FIG. 22A.
Figure 23:
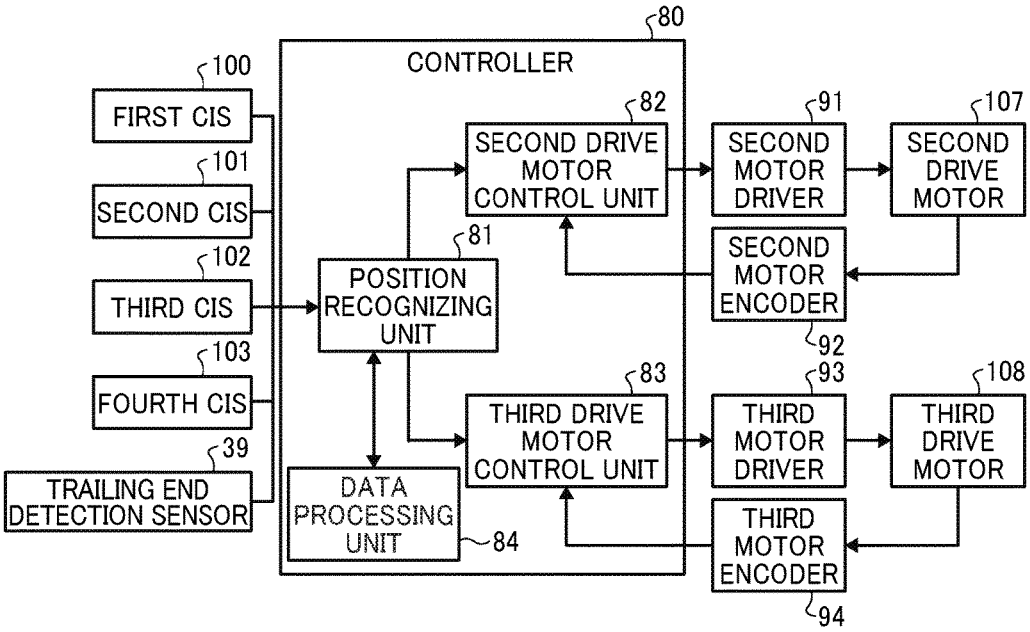
FIG. 23 is a block diagram illustrating a configuration of the sheet conveying device of FIG. 22.

Further, as another configuration illustrated in FIGS. 22A, 22B and 23A, four CISs, which are the first CIS 100, the second CIS 101, the third CIS 102 and the fourth CIS 103, and the trailing end detection sensor 39 may be employed to timely switch from the second detection to the third detection in response to detection of the trailing end Pc of the sheet P by the trailing end detection sensor 39. In this configuration, the second detection is performed by the second CIS 101 and the third CIS 102 and, after detection of the trailing end Pc of the sheet P by the trailing end detection sensor 39, the third detection is performed by the third CIS 102 and the fourth CIS 103. In this case, the third detection may start after the trailing end Pc of the sheet P has passed the second CIS 101. Therefore, as illustrated in FIGS. 22A and 22B, the trailing end detection sensor 39 is disposed downstream from the second CIS 101 in the sheet conveying direction.

As described above, similarly in the configuration having the four CISs (i.e., the first CIS 100, the second. CIS 101, the third CIS 102 and the fourth CIS 103), by timely switching the second detection and the third detection with the trailing end detection sensor 39, and the control can be performed easily. Further, the configuration of FIGS. 22A, 22B and 23 can spare a sufficient time from the time when the trailing end Pc of the sheet P passes the trailing end detection sensor 39 to the time when the trailing end Pc of the sheet P passes the third CIS 102. Therefore, the third detection can be performed over a long distance along the sheet conveying direction, and therefore a more accurate sheet position correction can be performed.

Figure 24A:
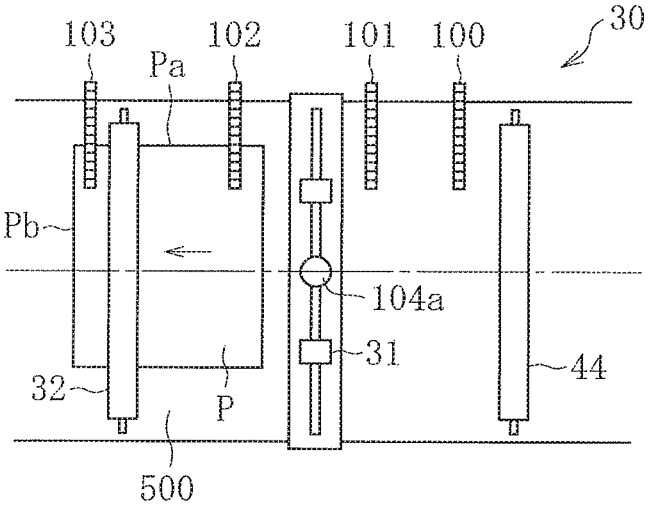
FIG. 24A is a plan view illustrating the sheet conveying device including the fourth CIS disposed downstream from a pair of timing rollers in a sheet conveying direction.
Figure 24B:
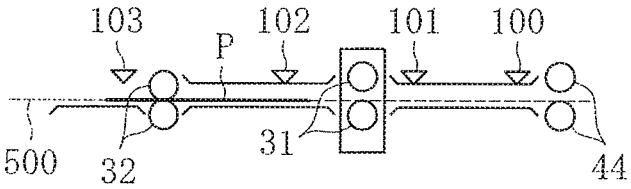
FIG. 24B is a side view illustrating the sheet conveying device of FIG. 24A.

Further, FIG. 24A is a plan view illustrating the sheet conveying device 30 including the fourth CIS 103 disposed downstream from the pair of timing rollers 32 in the sheet conveying direction and FIG. 24B is a side view illustrating the sheet conveying device 30 of FIG. 24A.

As illustrated in FIGS. 24A and 24B, the sheet conveying device 30 has another configuration in which the fourth CIS 103 is disposed downstream from the pair of timing rollers 32 in the sheet conveying direction. However, the fourth CIS 103 is disposed upstream from the secondary transfer portion 7 in the sheet conveying direction. Since the fourth CIS 103 is disposed at the above-described position, the positional deviation amount of the sheet P generated while the sheet is being conveyed by the pair of timing rollers 32 can be calculated through the third detection performed by the third CIS 102 and the fourth CIS 103. Accordingly, the sheet position correction is performed with the sum of the above-described positional deviation amount of the sheet P and the positional deviation amount of a subsequent sheet to be conveyed, and therefore a more accurate sheet position correction can be performed.

The above-described feedback control in which the information of the positional deviation of a preceding sheet is used for the sheet position correction of a subsequent sheet is preferable to be applied between sheets that are expected to have similar positional deviation amounts (for example, sheets having the same size and type and being fed from the same sheet tray). However, the feedback control acceptable to this disclosure is not limited thereto. For example, even in a case in which sheets have different degree of the positional deviation amounts according to the lengths and types thereof, if the sheets have the identical direction of the positional deviation, this disclosure can be applied to reduce the positional deviation amounts of the sheets.

Further, this disclosure is applied when multiple sheets are conveyed consecutively but is not limited thereto. For example, this disclosure may be applied to a configuration in which the image forming apparatus turns into a standby state after a sheet is conveyed and resumes when another sheet is conveyed. In this configuration, the information of the positional deviation of the preceding sheet before the resume of the image forming apparatus may be used for the sheet position correction of the subsequent sheet to be conveyed.

Further, in the above-described configurations, the sheet conveying device that conveys a sheet or sheets is applied to this disclosure. However, the configuration applicable to this disclosure is not limited thereto. For example, this disclosure can be employed to a sheet conveying device that conveys recording media such as overhead projector (OHP) sheets and OHP films on which an image is formed or sheets such as original documents, as well as sheets including plain papers, thick papers, thin papers, coated papers, label papers and envelopes. Further, this disclosure can be employed to not only a sheet conveying device that conveys a recording medium and a sheet such as an original document, but also a sheet conveying device that conveys a conveyance target medium such as a printed circuit board.

Further, the sheet conveying device 30 according to this disclosure is employed to the color image forming apparatus 1 as illustrated in FIG. 1. However, the sheet conveying device that can be applied to this disclosure may be employed to a monochrome (black and white) image forming apparatus or an image forming apparatus other than an electrophotographic image forming apparatus, for example, such as an inkjet image forming apparatus and an offset printing machine.

Figure 25:
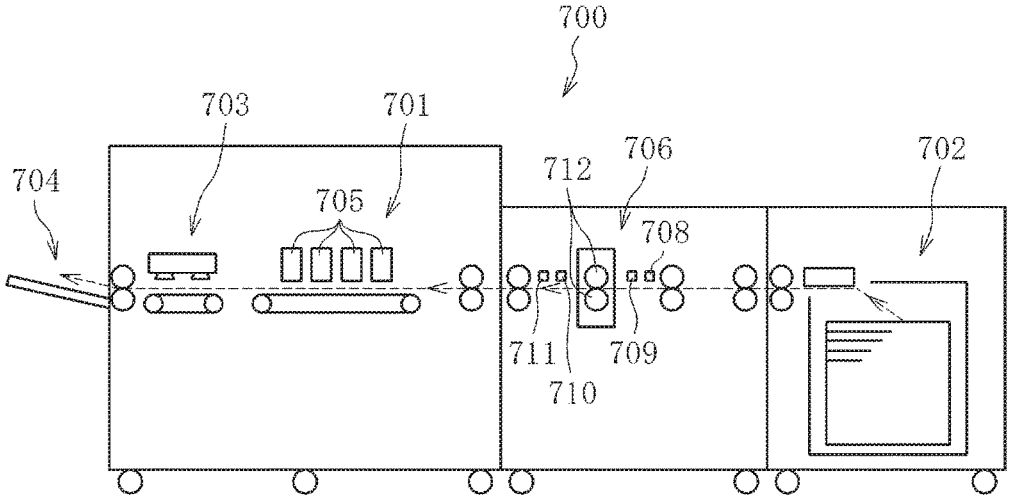
FIG. 25 is a schematic diagram illustrating an entire configuration of an image forming apparatus employing an inkjet recording method.

FIG. 25 is a schematic view illustrating a sheet conveying device employed in an inkjet image forming apparatus 700.

As illustrated in FIG. 25, the inkjet image forming apparatus 700 includes an image forming device 701, a sheet feeding device 702, a sheet conveying device 706, a drying device 703, and a sheet output device 704. The image forming device 701 includes multiple ink print heads 705 to discharge ink using an inkjet method. The sheet feeding device 702 feeds a sheet with an image formed thereon. The sheet conveying device 706 conveys the sheet. The drying device 703 dries the sheet with the image thereon. The sheet output device 704 ejects the sheet dried by the drying device 703. The sheet conveying device 706 includes multiple CISs 708, 709, 710 and 711 and a pair of sheet holding rollers 712 in a sheet conveying passage extending from the sheet feeding device 702 to the image forming device 701. Each of the multiple CISs 708, 709, 710 and 711 functions as a position detector to detect the position of the sheet. The pair of sheet holding rollers 712 functions as a position corrector to correct the position of the sheet based on detection results obtained by the multiple CISs 708, 709, 710 and 711. The pair of sheet holding rollers 712, while conveying the sheet fed by the sheet feeding device 702, corrects the lateral and angular displacements of the sheet based on the detection results of the multiple CISs 708, 709, 710 and 711. Thereafter, the sheet is conveyed to the image forming device 701. Consequently, respective color ink is discharged from the ink print heads 705 to the sheet in the image forming device 701, thereby forming an image on a surface of the sheet. After having been dried by the drying device 703, the sheet is ejected to the sheet output device 704.

In the inkjet image forming apparatus 700 described above, similar to the above-described configurations, two CISs (i.e., the CISs 710 and 711 in FIG. 25) are disposed downstream from the pair of sheet holding rollers 712 in the sheet conveying direction. Therefore, the positional deviation amount generated during sheet conveyance by the pair of sheet holding rollers 712 or generated on the downstream side of the pair of sheet holding rollers 712 in the sheet conveying direction can be calculated sufficiently (over a wide range). Consequently, by using the information of the positional deviation of the preceding sheet obtained based on the detection results of the CISs (i.e., the CISs 710 and 711) for the sheet position correction of the subsequent sheet, a more accurate sheet position correction can be performed reliably.

Further, the sheet conveying device according to this disclosure can also be applied to a post processing device that performs post processing such as a stapling process and a folding process to a sheet output from an image forming apparatus after an image has been transferred onto the sheet.

Figure 26:
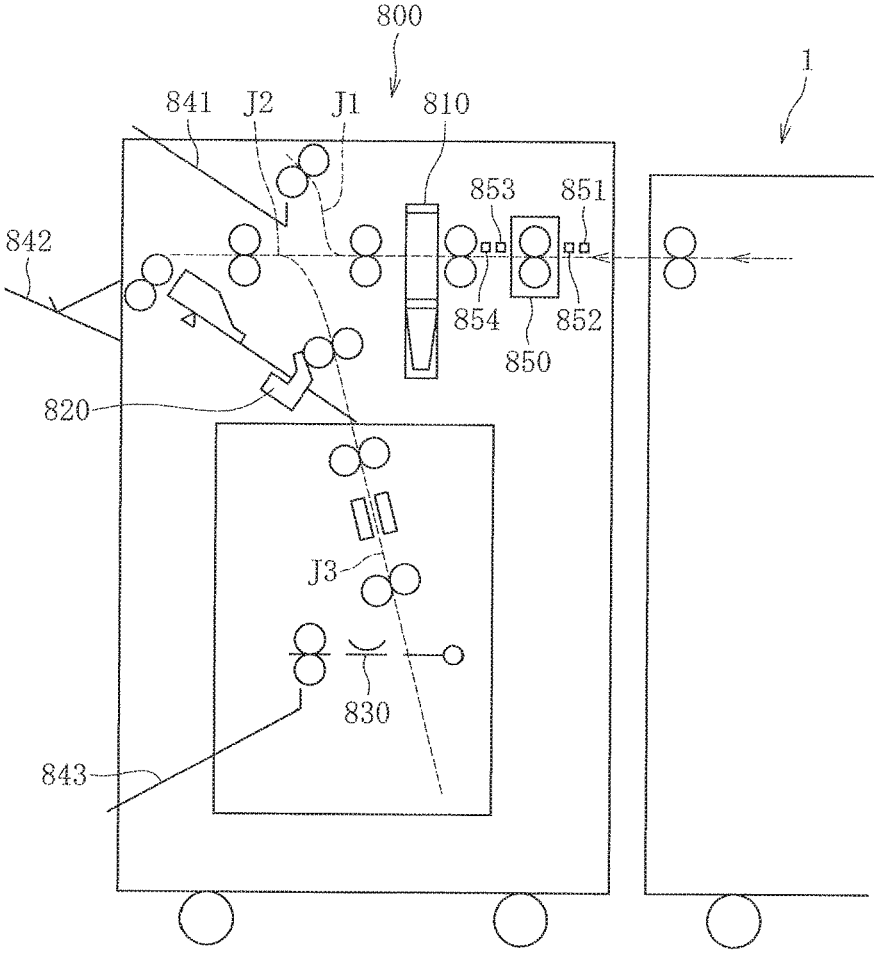
FIG. 26 is a schematic diagram illustrating an entire configuration of a post processing device.

Now, a description is given of a post processing device 800 to which this disclosure is applied, with reference to FIG. 26.

FIG. 26 is a schematic diagram illustrating an entire configuration of the post processing device 800.

The post processing device 800 illustrated in FIG. 26 includes a punching device 810, a stapling device 820, a sheet folding device 830 and multiple sheet trays (sheet stackers), which are a first sheet tray 841, a second sheet tray 842 and a third sheet tray 843. The punching device 810 performs a punching process to punch or open holes on a sheet P. The stapling device 820 performs a binding process of a sheet P. The sheet folding device 830 performs a center folding process of a sheet P. The post processing device 800 has three sheet conveyance passages, which are a first sheet conveyance passage J1, a second sheet conveyance passage J2 and a third sheet conveyance passage J3 to perform different post processing operations. After being fed from the image forming apparatus 1, the sheet P is conveyed to a corresponding one of the three sheet conveyance passages J1, J2 and J3.

The first sheet conveyance passage J1 is a sheet conveyance passage to convey the sheet P to the first sheet tray 841 after the punching process performed by the punching device 810 or without the punching process. The second sheet conveyance passage J2 is a sheet conveyance passage to convey the sheet P to the second sheet tray 842 after the binding process performed by the stapling device 820. The third sheet conveyance passage J3 is a sheet conveyance passage to convey the sheet P to the third sheet tray 843 after the center folding process performed by the sheet folding device 830.

As illustrated in FIG. 26, the sheet P that is fed from the image forming apparatus 1 to the post processing device 800 is conveyed to the first CIS 851 and the second CIS 852 disposed upstream from the punching device 810 in the sheet conveying direction, where the first detection is performed. Then, based on the result of the first detection, the pair of sheet holding rollers 850 performs the pick up and hold operation. Accordingly, the primary correction is performed to the sheet P. Then, the sheet P is conveyed to the second CIS 852 and the third CIS 853, where the second detection is performed. Based on the result of the second detection, the pair of sheet holding rollers 850 is driven to perform the secondary correction. Thereafter, the sheet P is conveyed to the third CIS 853 and the fourth CIS 854, where the third detection is performed to the sheet P while the sheet P is being conveyed. Consequently, by using the information of the positional deviation of the sheet P obtained based on the result of the third detection for the sheet position correction of a subsequent sheet to be conveyed, the accuracy of the punching process, the binding process or the center folding process is enhanced.

The above-described embodiments are illustrative and do not limit this disclosure. Thus, numerous additional modifications and variations are possible in light of the above teachings. For example, elements at least one of features of different illustrative and exemplary embodiments herein may be combined with each other at least one of substituted for each other within the scope of this disclosure and appended claims. Further, features of components of the embodiments, such as the number, the position, and the shape are not limited the embodiments and thus may be preferably set. It is therefore to be understood that within the scope of the appended claims, the disclosure of this disclosure may be practiced otherwise than as specifically described herein.

What is claimed is:

1. A sheet conveying device comprising:

multiple position detectors aligned along a sheet conveying direction and configured to detect a side end of a sheet; and a position corrector, including at least one controller, configured to control at least one motor to convey the sheet and to control the at least one motor to correct a position of the sheet based on a positional deviation amount of the sheet, obtained by receipt of a detection result of the multiple position detectors, a position of a subsequent sheet being corrected based on a sum of the positional deviation amount of the sheet and a positional deviation amount of the subsequent sheet, wherein the multiple position detectors include:

a first position detector disposed upstream from the position corrector in the sheet conveying device;

a second position detector disposed downstream from the first position detector and downstream from the position corrector in the sheet conveying device;

a third position detector disposed downstream from the position corrector in the sheet conveying direction; and a fourth position detector disposed downstream from the third position detector in the sheet conveying direction, wherein the first position detector and the second position detector are configured to perform a first detection to detect the position of the sheet, wherein the position corrector is configured to control the at least one motor to perform a primary correction by which the position of the sheet is corrected based on a positional deviation amount obtained by the first detection, wherein the second position detector and the third position detector are configured to perform a second detection to detect the position of the sheet, wherein the position corrector is configured to control the at least one motor to perform a secondary correction by which the position of the sheet is corrected based on a positional deviation amount obtained by the second detection, and the at least one controller being configured to control the at least one motor to perform either one of the primary correction and the secondary correction to correct the position of the sheet based upon a sum of a positional deviation amount of the sheet obtained by a detection result of the third positional detector and the fourth positional detector and a positional deviation amount of a subsequent sheet conveyed after the sheet, obtained by either one of the first detection and the second detection.

2. The sheet conveying device according to claim 1, further comprising a trailing end detection sensor configured to detect a trailing end of the sheet, wherein either one of the primary correction and the secondary correction is configured to be performed by a sum of a positional deviation amount of the sheet obtained by the detection result of the third positional detector and the fourth positional detector after the trailing end detection sensor has detected the trailing end of the sheet and a positional deviation amount of a subsequent sheet conveyed after the sheet, obtained by either one of the first detection and the second detection.

3. The sheet conveying device according to claim 1, wherein a distance between two adjacent position detectors in the sheet conveying direction is relatively smaller than at least a shortest length of the sheet.

4. The sheet conveying device according to claim 1, wherein a positional deviation amount of the sheet is an angular displacement amount detected by a second upstream position detector aligned along the sheet conveying direction.

5. The sheet conveying device according to claim 1, further comprising a transfer portion disposed downstream from the position corrector in the sheet conveying direction and configured to transfer an image onto the sheet, wherein the multiple position detectors are disposed upstream from the transfer portion in the sheet conveying direction.

6. An image forming apparatus comprising the sheet conveying device according to claim 1.

7. A post processing device comprising:

a sheet receiving device configured to receive a sheet conveyed from an image forming apparatus; and the sheet conveying device according to claim 1.

8. A sheet conveying device comprising:

multiple position detectors aligned along a sheet conveying direction and configured to detect a side end of a sheet; and a position corrector, including at least one controller, configured to control at least one motor to convey the sheet and to control the at least one motor to correct a position of the sheet based on a positional deviation amount of the sheet, obtained by a detection result of the multiple position detectors, a position of a subsequent sheet being corrected based on a sum of the positional deviation amount of the sheet and a positional deviation amount of the subsequent sheet, wherein the multiple position detectors include:

a first position detector disposed upstream from the position corrector in the sheet conveying device;

a second position detector disposed downstream from the first position detector and downstream from the position corrector in the sheet conveying device; and a third position detector disposed downstream from the position corrector in the sheet conveying direction, wherein the first position detector and the second position detector are configured to perform a first detection to detect the position of the sheet, wherein the position corrector is configured to control the at least one motor to perform a primary correction by which the position of the sheet is corrected based on a positional deviation amount obtained by the first detection, wherein the second position detector and the third position detector are configured to perform a second detection to detect the position of the sheet, wherein the position corrector is configured to control the at least one motor to perform a secondary correction by which the position of the sheet is corrected based on a positional deviation amount obtained by the second detection, and the at least one controller being configured to control the at least one motor to perform either one of the primary correction and the secondary correction to correct the position of the sheet based upon a sum of a positional deviation amount of the sheet obtained by a detection result of the second positional detector and the third positional detector and a positional deviation amount of a subsequent sheet conveyed after the sheet, obtained by either one of the first detection and the second detection.

9. The sheet conveying device according to claim 8, further comprising a trailing end detection sensor configured to detect a trailing end of the sheet, wherein either one of the primary correction and the secondary correction is configured to be performed by a sum of a positional deviation amount of the sheet obtained by the detection result of the second positional detector and the third positional detector after the trailing end detection sensor has detected the trailing end of the sheet and a positional deviation amount of a subsequent sheet conveyed after the sheet, obtained by either one of the first detection and the second detection.

10. The sheet conveying device according to claim 8, wherein a distance between two adjacent position detectors in the sheet conveying direction is relatively smaller than at least a shortest length of the sheet.

11. The sheet conveying device according to claim 8, wherein a positional deviation amount of the sheet is an angular displacement amount detected by a second upstream position detector aligned along the sheet conveying direction.

12. The sheet conveying device according to claim 8, further comprising a transfer portion disposed downstream from the position corrector in the sheet conveying direction and configured to transfer an image onto the sheet, wherein the multiple position detectors are disposed upstream from the transfer portion in the sheet conveying direction.

13. An image forming apparatus comprising the sheet conveying device according to claim 8.

14. A post processing device comprising:

a sheet receiving device configured to receive a sheet conveyed from an image forming apparatus; and the sheet conveying device according to claim 8.

* * * * *